US008635725B2

(12) United States Patent
Tannoury et al.

(10) Patent No.: US 8,635,725 B2
(45) Date of Patent: Jan. 28, 2014

(54) PRONE AND LATERALLY ANGLED SURGICAL DEVICE AND METHOD

(76) Inventors: Tony Y. Tannoury, Andover, MA (US); Thomas K. Skripps, Acton, MA (US)

( * ) Notice: Subject to any disclaimer, the term of this patent is extended or adjusted under 35 U.S.C. 154(b) by 747 days.

(21) Appl. No.: 12/607,700

(22) Filed: Oct. 28, 2009

(65) Prior Publication Data

US 2010/0192300 A1 Aug. 5, 2010

Related U.S. Application Data

(60) Provisional application No. 61/109,085, filed on Oct. 28, 2008.

(51) Int. Cl.
*A47B 7/00* (2006.01)
*A47B 7/02* (2006.01)

(52) U.S. Cl.
USPC ..... 5/607; 5/621

(58) Field of Classification Search
USPC ..... 5/607, 621
See application file for complete search history.

(56) References Cited

U.S. PATENT DOCUMENTS

| | | | | | |
|---|---|---|---|---|---|
| 205,659 | A | * | 7/1878 | Lovins | 5/607 |
| 520,576 | A | * | 5/1894 | Scearce | 5/83.1 |
| 746,311 | A | * | 12/1903 | Emigh | 5/607 |
| 870,324 | A | | 11/1907 | Thorner | |
| 933,471 | A | | 9/1909 | Bdwabd | |
| 1,185,054 | A | * | 5/1916 | Buckley | 5/607 |
| 2,188,592 | A | | 1/1940 | Hosken | |
| 2,452,816 | A | | 11/1948 | Wagner | |
| 2,509,086 | A | | 5/1950 | Eaton | |
| 2,586,417 | A | | 2/1952 | Cole | |
| 2,688,142 | A | | 9/1954 | Jensen | |
| 2,698,445 | A | * | 1/1955 | More | 5/412 |
| 2,902,701 | A | * | 9/1959 | Driskill | 5/607 |
| 3,013,281 | A | * | 12/1961 | Steiner | 5/607 |
| 3,042,025 | A | | 7/1962 | Jackson | |
| 3,053,568 | A | * | 9/1962 | Miller | 297/78 |
| 3,099,441 | A | | 7/1963 | Frederick | |
| 3,188,079 | A | | 6/1965 | Boetcker et al. | |
| 3,284,815 | A | * | 11/1966 | Grossman et al. | 5/607 |
| 3,493,225 | A | | 2/1970 | Ceraldi | |
| 3,528,413 | A | | 9/1970 | Aydt | |
| 3,572,835 | A | | 3/1971 | Kees, Jr. et al. | |
| 3,605,145 | A | | 9/1971 | Graebe | |
| 3,656,190 | A | | 4/1972 | Rothstein et al. | |
| 3,694,831 | A | | 10/1972 | Treace | |
| 3,717,885 | A | * | 2/1973 | De Mare | 5/607 |

(Continued)

FOREIGN PATENT DOCUMENTS

| | | |
|---|---|---|
| EP | 1 946 727 A3 | 9/2009 |
| WO | 01/93796 A2 | 12/2001 |

OTHER PUBLICATIONS

PCT International Search Report and Written Opinion for counterpart PCT/US2009/062339, 15 pages, Dec. 22, 2009.

*Primary Examiner* — Robert G Santos
*Assistant Examiner* — David E Sosnowski
(74) *Attorney, Agent, or Firm* — Barnes & Thornburg LLP

(57) ABSTRACT

A method and apparatus of positioning in multiple positions during spinal surgery includes deviating a patient support apparatus about a longitudinal axis to a position in which one lateral side of the apparatus is lower than the opposite lateral side, positioning a patient in a prone position on the deviated product, and rotating the patient from the prone position to a laterally angled position.

16 Claims, 16 Drawing Sheets

(56) References Cited

U.S. PATENT DOCUMENTS 3,761,128 A 9/1973 Schenk
3,811,140 A 5/1974 Burpo
3,828,377 A 8/1974 Fary, Sr.
3,873,081 A 3/1975 Smith et al.
3,897,777 A 8/1975 Morrison et al.
3,919,730 A 11/1975 Regan et al.
3,946,425 A 3/1976 Shoji et al.
3,946,452 A 3/1976 Eary
3,947,686 A 3/1976 Cooper
3,957,262 A 5/1976 McReynolds
4,018,412 A 4/1977 Kees et al.
4,028,754 A 6/1977 Eary
4,033,339 A 7/1977 Roberts et al.
4,034,748 A 7/1977 Winner
4,054,282 A 10/1977 Hamer
4,054,960 A 10/1977 Pettit
4,108,426 A 8/1978 Lindstroem
4,139,917 A 2/1979 Fenwick
4,159,093 A 6/1979 Hamilton
4,169,478 A 10/1979 Hickmann
4,225,125 A 9/1980 Lee
4,239,200 A 12/1980 Sarrafian et al.
4,243,025 A 1/1981 Jones
4,346,488 A 8/1982 Eary
4,378,108 A 3/1983 Bailey
4,391,438 A 7/1983 Heffington
4,398,707 A 8/1983 Cloward
D271,834 S 12/1983 Huntsinger
4,455,698 A 6/1984 Eary
4,471,364 A 9/1984 Kocot
4,472,847 A 9/1984 Gammons et al.
4,474,364 A 10/1984 Brendgord
4,484,911 A 11/1984 Berlin et al.
4,504,050 A 3/1985 Osborne
4,506,872 A 3/1985 Westerberg et al.
4,520,800 A 6/1985 Kowalski
4,526,355 A 7/1985 Moore et al.
4,527,555 A 7/1985 Ruf
4,527,787 A 7/1985 Collis
4,531,247 A 7/1985 Eary
4,545,572 A 10/1985 Day
4,549,501 A 10/1985 Anderson
4,558,857 A 12/1985 Heller
4,559,930 A 12/1985 Cobiski
4,562,588 A 12/1985 Ruf
4,579,111 A 4/1986 Ledesma
4,583,725 A 4/1986 Arnold
4,616,813 A 10/1986 McConnell
4,620,697 A 11/1986 Pithon
4,635,914 A 1/1987 Kabanek
4,653,482 A 3/1987 Kurland
4,662,619 A 5/1987 Ray et al.
4,671,728 A 6/1987 Clark
4,672,952 A * 6/1987 Vrzalik ..... 601/90
4,702,465 A 10/1987 McConnell
4,706,313 A 11/1987 Murphy
4,710,991 A 12/1987 Wilmore et al.
4,712,781 A 12/1987 Watanabe
4,717,133 A 1/1988 Walsh et al.
4,723,329 A 2/1988 Vaccaro
4,752,064 A 6/1988 Voss
4,757,983 A 7/1988 Ray et al.
4,788,730 A 12/1988 Bexton
4,823,776 A 4/1989 Foster et al.
4,827,541 A 5/1989 Vollman
4,840,362 A 6/1989 Bremer et al.
4,840,363 A 6/1989 McConnell
4,852,840 A 8/1989 Marks
4,856,128 A * 8/1989 Alsip et al. ..... 5/607
4,865,484 A 9/1989 McConnell
4,866,796 A 9/1989 Robinson et al.
4,872,656 A 10/1989 Brendgord et al.
4,908,892 A 3/1990 Michelson
4,918,774 A 4/1990 Popitz
4,923,187 A 5/1990 Mombrinie
4,939,801 A * 7/1990 Schaal et al. ..... 5/607
4,944,059 A 7/1990 Wall
4,944,060 A 7/1990 Peery et al.
4,952,318 A 8/1990 Pasternak et al.
4,955,096 A 9/1990 Gilroy et al.
4,979,519 A 12/1990 Chavarria et al.
4,989,848 A 2/1991 Monroe
4,995,067 A 2/1991 Royster et al.
5,009,407 A 4/1991 Watanabe
5,014,375 A 5/1991 Coonrad et al.
5,044,026 A 9/1991 Matthews
5,052,068 A 10/1991 Graebe
5,081,665 A 1/1992 Kostich
5,081,728 A 1/1992 Skinner
5,088,706 A 2/1992 Jackson
5,131,105 A * 7/1992 Harrawood et al. ..... 5/607
5,131,106 A 7/1992 Jackson
5,163,193 A 11/1992 Whitmore
5,197,975 A 3/1993 Mombrinie
5,207,716 A 5/1993 McReynolds et al.
5,214,815 A 6/1993 Agbodoe et al.
5,220,699 A 6/1993 Farris
5,233,713 A 8/1993 Murphy et al.
5,239,716 A 8/1993 Fisk
5,269,035 A 12/1993 Hartunian
5,276,927 A 1/1994 Day
5,279,310 A 1/1994 Hsien
5,287,576 A 2/1994 Fraser
5,297,303 A 3/1994 Stafford et al.
5,297,539 A 3/1994 Liebl et al.
5,317,771 A 6/1994 Cook
5,367,730 A 11/1994 Sher
5,390,383 A * 2/1995 Carn ..... 5/624
5,408,713 A 4/1995 Stratton
5,427,436 A 6/1995 Lloyd
5,444,882 A 8/1995 Andrews et al.
5,452,728 A 9/1995 Iams
5,489,258 A 2/1996 Wohnsen et al.
5,509,160 A 4/1996 Schubert
5,515,867 A 5/1996 Lamb
5,520,623 A 5/1996 Williams
5,524,639 A 6/1996 Lanier et al.
5,528,782 A * 6/1996 Pfeuffer et al. ..... 5/611
5,531,229 A 7/1996 Dean et al.
5,535,466 A 7/1996 Snell
5,564,663 A 10/1996 Cook et al.
5,566,682 A 10/1996 Yavitz
5,569,175 A 10/1996 Chitwood
5,575,027 A 11/1996 Mueller
5,584,302 A 12/1996 Sillaway et al.
5,613,254 A 3/1997 Clayman et al.
5,613,501 A 3/1997 Michelson
5,615,432 A 4/1997 Von Ohlen
5,628,078 A 5/1997 Pennington et al.
5,638,565 A 6/1997 Pekar
5,640,729 A * 6/1997 Marino ..... 5/607
5,642,302 A 6/1997 Dumont et al.
5,655,238 A 8/1997 Stickley et al.
5,658,315 A 8/1997 Lamb et al.
5,661,859 A 9/1997 Schaefer
5,675,851 A 10/1997 Feathers
5,680,861 A 10/1997 Rohling
5,708,999 A 1/1998 Priolo et al.
5,741,210 A 4/1998 Dobrovolny
5,758,374 A 6/1998 Ronci
5,758,647 A 6/1998 Cummins
5,771,514 A 6/1998 Wilhoit
5,860,899 A * 1/1999 Rassman ..... 482/142
5,916,189 A 6/1999 Sullenperger et al.
5,926,876 A 7/1999 Haigh et al.
D414,974 S 10/1999 Marrone
5,960,494 A 10/1999 Gilliland et al.
6,001,076 A 12/1999 Wilson et al.
6,003,174 A 12/1999 Kantrowitz et al.
6,047,420 A 4/2000 Priester et al.
6,065,165 A 5/2000 Delk et al.
6,076,208 A 6/2000 Heimbrock et al.
6,076,525 A 6/2000 Hoffman
6,108,840 A 8/2000 Heimbrock et al.

(56) References Cited

U.S. PATENT DOCUMENTS

| | | | | |
|---|---|---|---|---|
| 6,112,333 | A | 9/2000 | Mazzei | |
| 6,112,349 | A * | 9/2000 | Connolly | 5/607 |
| 6,115,861 | A | 9/2000 | Reeder et al. | |
| 6,120,397 | A | 9/2000 | Julian | |
| 6,138,302 | A | 10/2000 | Sashin et al. | |
| 6,138,304 | A | 10/2000 | Lipsky et al. | |
| 6,151,734 | A | 11/2000 | Lawrie | |
| 6,151,735 | A | 11/2000 | Koby et al. | |
| 6,154,901 | A | 12/2000 | Carr | |
| 6,154,903 | A | 12/2000 | Wai-Chung | |
| 6,154,907 | A | 12/2000 | Cinquin | |
| 6,195,820 | B1 | 3/2001 | Heimbrock et al. | |
| 6,199,233 | B1 | 3/2001 | Kantrowitz et al. | |
| 6,199,552 | B1 | 3/2001 | Crespo | |
| 6,199,812 | B1 | 3/2001 | Schuepbach | |
| 6,202,230 | B1 | 3/2001 | Borders | |
| 6,212,712 | B1 * | 4/2001 | Topp | 5/610 |
| 6,212,720 | B1 | 4/2001 | Antinori et al. | |
| 6,237,172 | B1 | 5/2001 | Morgan, Sr. | |
| 6,241,711 | B1 | 6/2001 | Weissberg et al. | |
| 6,249,923 | B1 | 6/2001 | Heimbrock et al. | |
| 6,260,220 | B1 | 7/2001 | Lamb et al. | |
| 6,276,012 | B2 | 8/2001 | Borders | |
| 6,295,671 | B1 | 10/2001 | Reesby et al. | |
| 6,311,349 | B1 * | 11/2001 | Kazakia et al. | 5/624 |
| 6,324,710 | B1 | 12/2001 | Hernandez et al. | |
| 6,336,412 | B2 | 1/2002 | Heimbrock et al. | |
| D456,516 | S | 4/2002 | Cheshaek | |
| 6,367,106 | B1 | 4/2002 | Gronsman | |
| 6,374,439 | B2 | 4/2002 | Heimbrock et al. | |
| 6,385,802 | B1 | 5/2002 | Roberts et al. | |
| 6,397,414 | B1 | 6/2002 | Lloyd | |
| 6,421,855 | B2 * | 7/2002 | Mann | 5/617 |
| 6,427,272 | B1 | 8/2002 | Yacoub | |
| 6,427,273 | B1 | 8/2002 | Berke et al. | |
| 6,428,497 | B1 | 8/2002 | Crouch | |
| 6,442,777 | B1 | 9/2002 | Pauli | |
| 6,446,287 | B2 | 9/2002 | Borders | |
| 6,490,737 | B1 | 12/2002 | Mazzei et al. | |
| 6,510,852 | B1 | 1/2003 | Shiery et al. | |
| 6,526,609 | B2 | 3/2003 | Wong | |
| 6,532,609 | B2 | 3/2003 | Taylor | |
| 6,557,195 | B2 | 5/2003 | Dinkler | |
| 6,561,194 | B2 | 5/2003 | Michelson | |
| 6,564,406 | B2 | 5/2003 | VanSteenburg et al. | |
| RE38,135 | E | 6/2003 | Stolpmann et al. | |
| 6,578,215 | B1 | 6/2003 | Heimbrock et al. | |
| 6,584,630 | B1 | 7/2003 | Dinkler | |
| 6,594,839 | B1 | 7/2003 | Papay | |
| 6,622,324 | B2 | 9/2003 | VanSteenburg et al. | |
| 6,637,058 | B1 | 10/2003 | Lamb | |
| 6,651,281 | B1 * | 11/2003 | Figiel | 5/612 |
| 6,701,553 | B1 | 3/2004 | Hand et al. | |
| 6,718,581 | B2 | 4/2004 | Riach | |
| 6,739,006 | B2 | 5/2004 | Borders et al. | |
| 6,754,923 | B2 | 6/2004 | Borders et al. | |
| D497,430 | S | 10/2004 | Tinsley | |
| 6,813,788 | B2 | 11/2004 | Dinkler et al. | |
| 6,817,363 | B2 * | 11/2004 | Biondo et al. | 128/845 |
| 6,941,951 | B2 * | 9/2005 | Hubert et al. | 128/845 |
| 6,966,081 | B1 * | 11/2005 | Sharps et al. | 5/81.1 R |
| 7,017,211 | B2 | 3/2006 | Krywiczanin et al. | |
| 7,089,613 | B2 | 8/2006 | Cohen | |
| 7,117,551 | B1 | 10/2006 | Dinkler, II et al. | |
| 7,146,664 | B1 | 12/2006 | Grosvenor | |
| 7,197,778 | B2 * | 4/2007 | Sharps | 5/81.1 R |
| 7,234,180 | B2 | 6/2007 | Horton et al. | |
| 7,239,906 | B1 * | 7/2007 | Green et al. | 600/407 |
| 7,322,059 | B2 * | 1/2008 | Hornbach | 5/607 |
| 7,328,469 | B2 * | 2/2008 | Vrzalik et al. | 5/607 |
| 7,426,759 | B2 * | 9/2008 | Donaldson | 5/607 |
| 7,451,505 | B2 * | 11/2008 | Johannsen | 5/607 |
| 7,496,980 | B2 * | 3/2009 | Sharps | 5/621 |
| 7,520,007 | B2 * | 4/2009 | Skripps | 5/621 |
| 7,520,008 | B2 | 4/2009 | Wong et al. | |
| 7,565,708 | B2 * | 7/2009 | Jackson | 5/611 |
| 7,600,281 | B2 | 10/2009 | Skripps | |
| 7,669,262 | B2 * | 3/2010 | Skripps et al. | 5/621 |
| 7,716,762 | B2 * | 5/2010 | Ferraresi et al. | 5/612 |
| 7,882,583 | B2 * | 2/2011 | Skripps | 5/621 |
| 7,913,337 | B1 * | 3/2011 | Masson | 5/618 |
| 8,042,208 | B2 * | 10/2011 | Gilbert et al. | 5/607 |
| 8,157,757 | B2 * | 4/2012 | Ganti | 602/32 |
| 8,230,864 | B2 * | 7/2012 | Hunter, Jr. | 128/845 |
| 8,234,730 | B2 * | 8/2012 | Skripps | 5/621 |
| 8,234,731 | B2 * | 8/2012 | Skripps | 5/622 |
| 8,256,050 | B2 * | 9/2012 | Wong et al. | 5/648 |
| 2001/0039680 | A1 | 11/2001 | Boucher et al. | |
| 2002/0061225 | A1 | 5/2002 | Boucher et al. | |
| 2002/0061255 | A1 | 5/2002 | Nguyen et al. | |
| 2002/0170115 | A1 | 11/2002 | Borders et al. | |
| 2003/0121098 | A1 | 7/2003 | Wei | |
| 2003/0167569 | A1 | 9/2003 | Newkirk et al. | |
| 2004/0123389 | A1 * | 7/2004 | Boucher et al. | 5/623 |
| 2004/0133979 | A1 | 7/2004 | Newkirk et al. | |
| 2004/0133983 | A1 | 7/2004 | Newkirk et al. | |
| 2006/0117483 | A1 * | 6/2006 | Devitt | 5/621 |
| 2006/0185091 | A1 * | 8/2006 | Jackson | 5/621 |
| 2006/0242765 | A1 | 11/2006 | Skripps et al. | |
| 2006/0248650 | A1 | 11/2006 | Skripps et al. | |
| 2006/0253985 | A1 | 11/2006 | Skripps | |
| 2006/0255220 | A1 | 11/2006 | Skripps | |
| 2007/0113336 | A1 * | 5/2007 | Sharps | 5/81.1 R |
| 2009/0013469 | A1 * | 1/2009 | Johnson | 5/612 |
| 2010/0192300 | A1 * | 8/2010 | Tannoury et al. | 5/607 |
| 2011/0099716 | A1 * | 5/2011 | Jackson | 5/607 |
| 2011/0119829 | A1 * | 5/2011 | Skripps et al. | 5/601 |
| 2012/0012117 | A1 * | 1/2012 | Weinstein et al. | 128/845 |

* cited by examiner

PRONE AND LATERALLY ANGLED SURGICAL DEVICE AND METHOD

This application claims priority under 35 U.S.C. §119(e) to U.S. Provisional Application Ser. No. 61/109,085, filed Oct. 28, 2008, which is expressly incorporated by reference herein.

BACKGROUND OF THE INVENTION

The present disclosure is related to a method and apparatus for positioning a patient during spinal surgery. More specifically, the present disclosure is related to a method and apparatus for positioning a patient in a prone position for posterior access to the spine and moving the patient to a laterally angled position for anterior access to the spine.

In spinal surgeries, surgeons access the anterior of the spine to remove a disk or other bone structure. The removed bone structure is replaced with a spacer referred to in the art as a cage. In some cases, it may be necessary to access the posterior of the spine to install fixation hardware such as screws and rods. With access to both sides of the spine being required in a single procedure, the patient is positioned in either a lateral or a supine position for the anterior approach. The patient is then repositioned in a prone position on a device that allows the abdomen to hang freely in a decompressed state.

Repositioning of the patient generally requires that the patient be moved relative to a supporting device, such as an operating table, for example. Such repositioning requires considerable effort on the part of caregivers to move the patient without complicating the procedure.

SUMMARY OF THE INVENTION

The present application discloses one or more of the features recited in the appended claims and/or the following features which, alone or in any combination, may comprise patentable subject matter:

According to one aspect of the present disclosure, a method of positioning a patient during spinal surgery includes rotating a patient support apparatus about a longitudinal axis such that a first lateral side of the patient support apparatus is lower than a second lateral side. The method also includes positioning patient supports on the patient support apparatus to provide a generally horizontal support for a patient in a prone position. The method further includes positioning the patient on the patient supports in the prone position. The method still further includes rotating the patient support apparatus about the longitudinal axis of the patient support apparatus such that the first lateral side is higher than the second lateral side.

A posterior approach to the spine may be made while the patient is in the prone position. An anterior approach to the spine may be made while the first lateral side of the patient support apparatus is higher than the second lateral side.

A patient support may be positioned in contact with the upper pelvic area of the patient while the patient is in the prone position. The method may further include moving the patient support that is in contact with the upper pelvic area of the patient is moved out of contact with the upper pelvic area when the first lateral side is higher than the second lateral side to expose the upper pelvic region for the anterior approach.

The patient support positioned in contact with the upper pelvic area may be removed from the patient support apparatus to expose the upper pelvic region for the anterior approach. The patient support positioned in contact with the upper pelvic area may be moved along the longitudinal axis of the patient support apparatus to expose the upper pelvic region for the anterior approach.

The method may further include rotating a portion of the patient support apparatus about a second axis parallel to the longitudinal axis of the patient support apparatus, the second axis spaced apart from the longitudinal axis of the patient support apparatus to increase the rotation of the patient relative to the patient support apparatus.

Positioning the supports on the patient support apparatus to provide a generally horizontal support for a patient in a prone position may include rotating a portion of the patient support apparatus about the second axis.

According to another aspect of the present disclosure, a method of positioning a patient during spinal surgery includes rotating an operating table about a longitudinal axis such that a first lateral side of the operating table is lower than a second lateral side. The method also includes positioning cushions on the operating table to provide a generally horizontal support for a patient in a prone position. The method further includes positioning the patient on the cushions in the prone position. The method still further includes rotating the operating table about the longitudinal axis of the operating table such that the first lateral side is higher than the second lateral side.

A posterior approach to the spine may be made while the patient is in the prone position. An anterior approach to the spine may be made while the first lateral side of the operating table is higher than the second lateral side.

A cushion may be positioned in contact with the upper pelvic area of the patient while the patient is in the prone position. The method may further include moving the cushion that is in contact with the upper pelvic area of the patient is moved out of contact with the upper pelvic area when the first lateral side is higher than the second lateral side to expose the upper pelvic region for the anterior approach.

The cushion positioned in contact with the upper pelvic area may be removed from the operating table to expose the upper pelvic region for the anterior approach. The cushion positioned in contact with the upper pelvic area may be moved along the longitudinal axis of the operating table to expose the upper pelvic region for the anterior approach. The cushion positioned in contact with the upper pelvic area may be moved vertically away from the patient to expose the upper pelvic region for the anterior approach.

The method may further include rotating a portion of a positioner supported on the operating table about a second axis parallel to the longitudinal axis of the operating table, the second axis spaced apart from the longitudinal axis of the operating table to increase the rotation of the patient relative to the operating table.

Positioning the supports on the operating table to provide a generally horizontal support for a patient in a prone position may include rotating the portion of the positioner about the second axis.

Rotating the portion of the positioner about the second axis may include manually lifting the portion of the positioner. Rotating the portion of the positioner about the second axis may include causing an actuator to be extended to rotate the portion of the positioner.

According to another aspect of the present disclosure an apparatus for positioning a patient during spinal surgery includes a frame including a support surface rotatable about a generally horizontal longitudinal axis of the frame. The apparatus also includes a cushion supported on the frame, the cushion supporting the patient in a prone position when the support surface of the patient support apparatus is rotated about the longitudinal axis of the frame to a first position. The apparatus further includes a lateral support supported on the frame, the lateral support engaging and supporting the patient when the support surface is rotated to a second position.

The cushion may be positioned to engage the upper pelvic region of the patient when the frame is in the first position. The cushion may be movable to a position in which the cushion does not engage the upper pelvic region of the patient when the frame is in the second position. The cushion may be removable from the frame. The cushion may be movable longitudinally along the frame to disengage from the upper pelvic region of the patient. The cushion may be movable away from the patient toward the frame to disengage the cushion from the upper pelvic region of the patient.

The second position may be a laterally angled position providing an anterior approach to the patient's spine. The first position may provide a posterior approach to the patient's spine.

The support surface may include two laterally spaced longitudinal rails and two spaced apart lateral cross-bars coupled to the longitudinal rails to form the support surface. The lateral cross-bars may include an angular offset with at least a portion of the cross-bars aligned at an angle not parallel to the longitudinal rails. The longitudinal rails may be in a generally horizontal orientation when the lateral cross-bars are in the first position.

The apparatus may further include a positioner supported on the support surface, the positioner including a patient supporting frame pivotable relative to the support surface about a pivot axis that is generally parallel to the longitudinal axis of the frame, the pivot axis spaced apart from the longitudinal axis of the frame.

The cushion may be supported on the positioner. The support surface may include two laterally spaced longitudinal rails. The positioner may be secured to the longitudinal rails.

The patient supporting frame of the positioner may include first and second laterally spaced longitudinal rails and a lateral cross-bar coupling the longitudinal rails of the frame of the positioner. The positioner may further include a lateral arm secured to the longitudinal rails of the support surface of the patient support apparatus, the patient supporting frame of the positioner pivotably connected to the lateral arm.

The positioner may further include an actuator that moves the patient supporting frame about the pivot axis of the positioner. The positioner may be manually movable about the second axis.

In yet another aspect of the present disclosure, a positioner for use with a patient support apparatus includes a lower frame and an upper frame pivotably coupled to the lower frame about an axis extending along the longitudinal length of the positioner, the axis positioned on a lateral side of the upper frame. The positioner further includes an arm for supporting the upper frame in a pivoted position relative to the lower frame.

The upper frame may support a patient. The lower frame may be securable to the patient support apparatus. The lower frame may include a plurality of lateral arms that extend laterally across a patient support apparatus.

The upper frame may include first and second lateral sides and first and second longitudinal ends. The upper frame may include two laterally spaced longitudinal rails and two lateral cross-bars connecting the longitudinal rails.

The upper frame and lower frame may be pinned together for pivotal movement therebetween.

The positioner may include carbon fiber components.

The arm may be a link that is movable to lock the upper frame in a pivoted position. The arm may be an actuator that is extendable to cause the upper frame to pivot about the axis.

When the upper frame includes two laterally spaced longitudinal rails and two lateral cross-bars connecting the longitudinal rails, the rails and cross-bars may cooperate to define a plane. The positioner may further include a cushion supported on the plane, the cushion having an upper surface for supporting a patient, the plane of the upper surface not parallel to the plane formed by the rails and the cross-bars.

According to still another aspect of the disclosure, a method of positioning a patient during spinal surgery includes rotating a patient support apparatus about a longitudinal axis such that a first lateral side of the patient support apparatus is lower than a second lateral side. The method also includes positioning patient supports on the patient support apparatus to provide a generally horizontal support for a patient in a prone position. The method further includes positioning the patient on the patient supports in the prone position. The method still further includes positioning a drape on the patient while the patient is in the prone position. The method also includes rotating the patient support apparatus about the longitudinal axis of the patient support apparatus such that the first lateral side is higher than the second lateral side without breaking the sterile field.

A posterior approach to the spine may be made while the patient is in the prone position. An anterior approach to the spine may be made while the first lateral side of the patient support apparatus is higher than the second lateral side.

The method may further include rotating a portion of the patient support apparatus about a second axis parallel to the longitudinal axis of the patient support apparatus, the second axis spaced apart from the longitudinal axis of the patient support apparatus to increase the rotation of the patient relative to the patient support apparatus.

Positioning the supports on the patient support apparatus to provide a generally horizontal support for a patient in a prone position may include rotating a portion of the patient support apparatus about the second axis.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
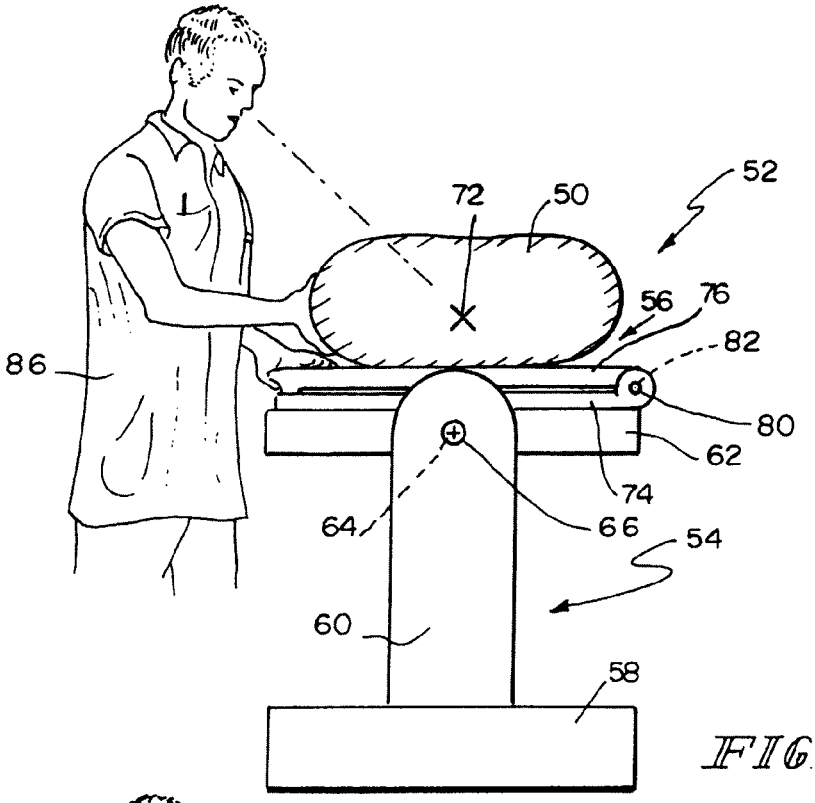
FIG. 1 is a diagrammatic representation of the position of a human body positioned on a surgical table in a prone position for posterior access to the spine of the human body.
Figure 2:
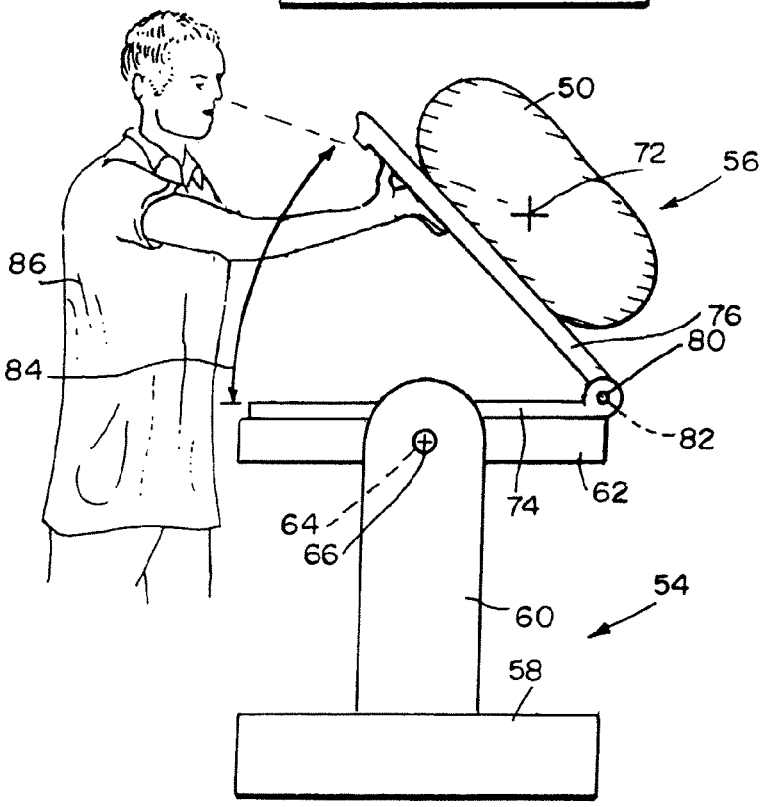
FIG. 2 is a diagrammatic representation of the position of the human body repositioned to a laterally angled position to permit lateral anterior access to the spine of the human body.
Figure 3:
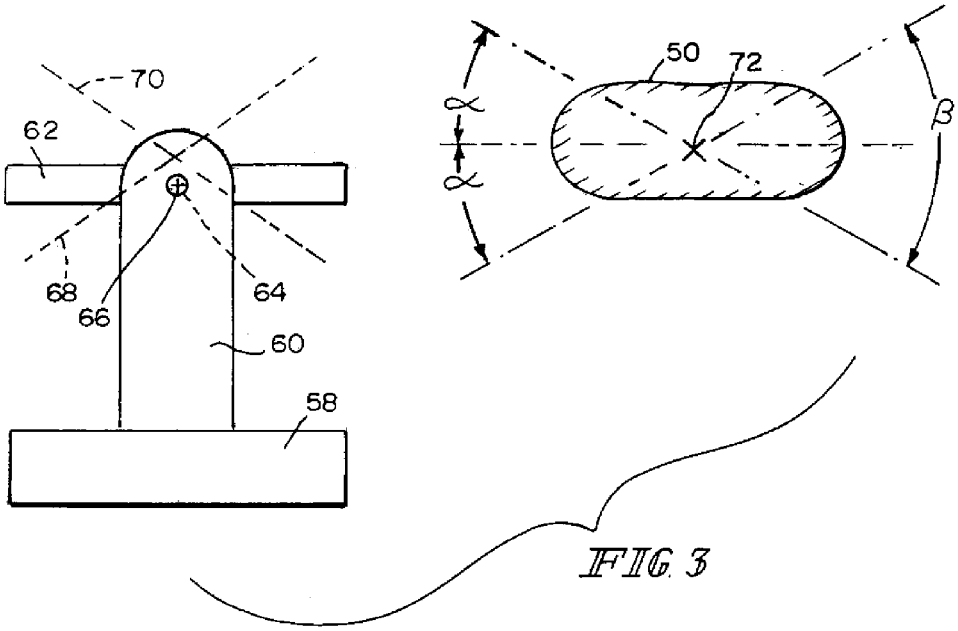
FIG. 3 is a diagrammatic representation of the movement of the top of a surgical table about a horizontal axis and the resulting variation in the position of the human body when the table is moved about the horizontal axis.

A method of positioning a patient 50 during spinal surgery includes the step of moving the patient between a prone position as shown in FIG. 1 and a laterally angled position shown FIG. 2. Illustratively, a patient support apparatus 52 includes an operating table 54 and a positioner 56 supported on the operating table 54. The operating table 54 includes a base 58 and a pedestal 60 supporting a table bed 62. The table bed 62 is supported on the pedestal 60 through a pivot 66 and pivotable relative to the pedestal 60 about a horizontal axis 64. As shown in FIG. 3, the table bed 62 is pivotable about the axis 64 between a first position represented by a line 68 and a second position represented by a line 70.

As shown diagrammatically in FIG. 3, the rotation of table bed 62 about the axis 64 results in pivoting of the patient 50 such that the spine 72 of the patient moves an angle alpha in each direction for a total angular adjustment of beta. It should be understood that the angles alpha and beta are not equivalent to the angle the table bed 62 is pivoted about the axis 64 as the spine 72 of the patient is positioned vertically above the pivot axis 64. Because of the distance between the spine 72 and the pivot axis 64, the spine 72 moves along an arc centered on the axis 64. Thus, the spine 72 is moved a greater distance from the prone position to a laterally angled position when the table bed 62 is pivoted. The offset of the spine 72 from the pivot axis 64 results in improved access to the anterior of the spine 72 in the laterally angled position.

Referring again now to FIGS. 1 and 2, the positioner 56 includes a base 74 and a support plate 76 which are each coupled to a pivot 80 so that the support plate 76 is pivotable relative to the base 74 about an axis 82. The axis 82 is offset from the axis 64 both vertically and horizontally such that movement about the axis 82 tends to increase the displacement of the spine 72 from the axis 64. In general, the support plate 76 moves through an angle 84 shown in FIG. 2. This movement tends to increase the movement of the spine 72 during rotation of the table bed 62 about axis 64 to provide improved access to the anterior of the spine 72. Thus, a surgeon 86 has posterior access to the spine 72 when the patient 50 is positioned on the positioner 56 as shown in FIG. 1 and has anterior access to the spine 72 when the support plate 76 is pivoted through the angle 84 as shown in FIG. 2. Additional movement to a more pronounced laterally angled position is possible by moving the table bed 62 to position 70 as shown in FIG. 3, thereby compounding the angular displacement of the table bed 62 and the support plate 76. It should be noted that while not shown explicitly in the diagrammatic representation of FIGS. 1 and 2, it contemplated that the positioner 56 and the table bed 62 may be configured to allow the abdomen of the patient 50 to hang freely when the patient 50 is supported on the positioner 56 and surgical table 54.

The apparatus disclosed in FIGS. 1-3 may be used in a method of spinal surgery which allows a patient 50 to be supported on a patient support apparatus 52 in a prone position as shown in FIG. 1. The patient 50 may then be repositioned by pivoting a portion of a positioner 56 about an axis 82 positioned laterally away from the spine 72 of the patient 50 to the position shown in FIG. 2 providing lateral access to the anterior of the spine 72. Improved laterally angled access to the anterior of the spine 72 may be made by rotating the table bed 62 about the axis 64 positioned vertically apart from the spine 72 to the table bed position 70 shown in FIG. 3. Using this method, the patient 50 does not have to be disengaged from the patient support apparatus 52 to accomplish the repositioning during the spinal surgery procedure. This reduces the potential for complications associated with re-positioning the patient 50 during a spinal surgical procedure. In addition, it reduces the labor and time required to reposition the patient 50, thereby reducing the time required for the procedure.

Figure 31:
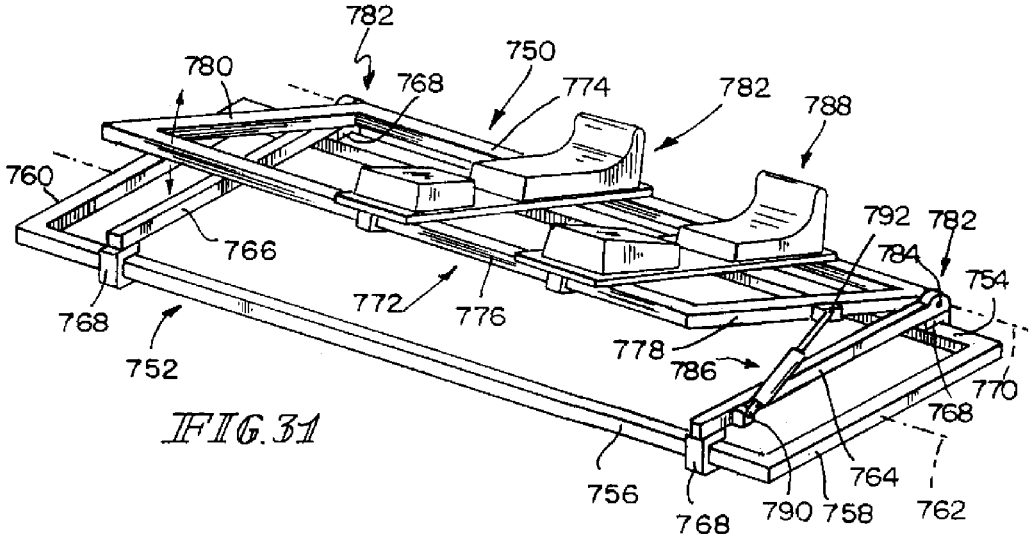
FIG. 31 is a perspective view of a positioner used with a patient support apparatus.
Figure 32:
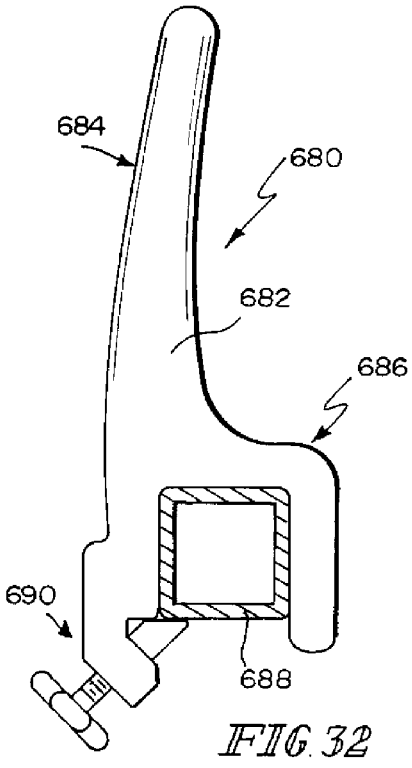
FIG. 32 is an end view of a lateral support positioned on the rail of a patient support apparatus.
Figure 33:
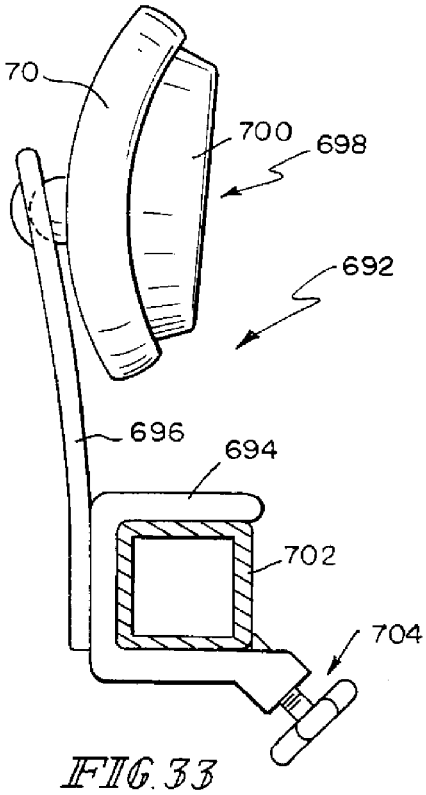
FIG. 33 is an end view of another embodiment of a lateral support positioned on the rail of a patient support apparatus

In another embodiment shown in FIG. 31, a positioner 750 is secured to a frame 752. The frame 752 includes two laterally spaced longitudinal rails 754 and 756. The frame 752 further includes two cross-bars 758 and 760 connecting the longitudinal rails 754 and 756. The frame 752 has a longitudinal axis 762 which is parallel to and centered between the longitudinal rails 754 and 756. The positioner 750 includes two lateral arms 764 and 766 which are secured to the rails 754 and 756 by a number of couplers 768. The positioner 750 further includes a patient supporting frame 772 which comprises a pair of laterally spaced longitudinal rails 774 and 776 connected together by a pair of lateral cross-bars 778 and 780. The lateral arms 764 and 766 are coupled to the frame 772 by a pair of pins 784 which defines a pivot axis 770 such that the frame is pivotable relative to the lateral arms 764 and 766. The axis 770 is parallel to the longitudinal axis 762 of the frame 752, but is spaced apart from the axis 762 in two directions, thereby offsetting the pivot axis 770 from the longitudinal axis 762.

The positioner 750 includes two body supports 782 and 788. Other embodiments of body supports discussed below may be substituted or used in combination with the body supports 782 and 788. The connection between the frame 772 and lateral arms 764 and 766 form hinges 782 at each connection. A pneumatic actuator 786 is coupled to a pivot support 790 on the lateral arm 764 and a pivot support 792 on the cross-bar 778 of the frame 772. Actuation of the pneumatic actuator 786 causes the frame 772 to pivot about the axis 770 to move a patient supported on the frame 772 to a laterally angled position. Retraction of the pneumatic actuator 786 lowers the frame 772 to a position in which the cross-bars 778 and 780 are parallel and adjacent to the lateral arms 764 and 766. In some embodiments, a second pneumatic actuator may be positioned at the opposite end of the positioner 750 to provide support to the cross-bar 780 of the frame 772. It should be noted that the pneumatic actuator 786 may be omitted and replaced with other actuators, such as hydraulic or electric actuators. In addition, the actuator may be replaced with a strut that is manually positioned to support the frame 772 to a raised position without the use of external power, the frame 772 being positioned by a caregiver.

With an understanding of the general concept of the method employing the apparatus of FIGS. 1-3, other embodiments are discussed below. For example, in the illustrative embodiment of a patient support apparatus 92 shown in FIGS. 4 and 5, the positioner 56 is omitted. Two supports 94 and 96 are positioned on the table bed 62 such that the patient 50 is supported on the supports 94 and 96 in a laterally angled position relative to the table bed 62. The supports 94 and 96 support the patient 50 in a prone position (shown in FIG. 4) when the table bed 62 is positioned in the position 68 of FIG. 3. The spine 72 is vertically offset from the pivot axis 64 by a distance 98. Thus, as the table bed 62 is moved from the position 68 to the position 70 through the angle beta, the patient 50 is positioned in a laterally angled position providing access to the anterior of the spine 72.

Figure 4:
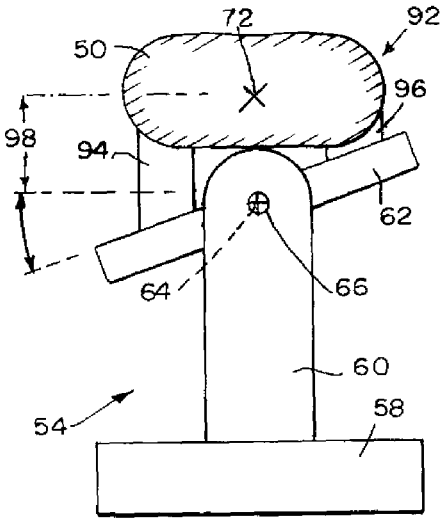
FIG. 4 is a diagrammatic representation of a surgical table supporting a human body on uneven supports, with the surgical table rotated about a horizontal axis such that the human is positioned in a prone position suitable for posterior access to the spine of the human body.
Figure 5:
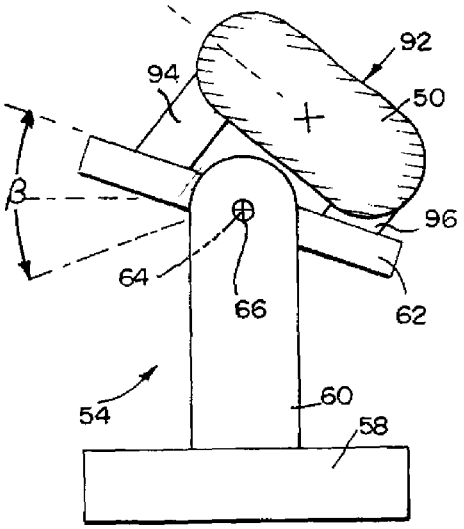
FIG. 5 is a diagrammatic representation of the surgical table in FIG. 4, with the table rotated about the horizontal axis to a second position suitable for laterally angled access to the spine of the human body.

To employ the structure illustrated in FIGS. 4 and 5, the method of spinal surgery includes moving the table bed 62 to an angled position 68 and placing supports 94 and 96 on the table bed 62. The patient 50 is supported on the supports 94 and 96 in a prone position. The table bed 62 is rotated about the pivot axis 64 to a second angled position 70 such that the patient is in a laterally angled position providing access to the anterior of the spine 72 of the patient 50. The spine 72 of the patient 50 is moved through an arc centered on axis 64 of the table 54.

Figure 6:
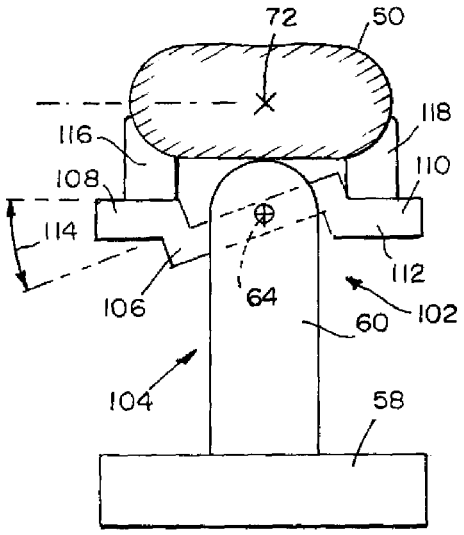
FIG. 6 is a diagrammatic representation of a surgical table supporting a human with an offset table bed, the surgical table rotated about a horizontal axis such that the human is positioned in a prone position suitable for posterior access to the spine of the human body.

In yet another embodiment, a patient support apparatus 102 includes an operating table 104 which is similar to the operating table 54. The table bed 62 is omitted in the operating table 104 and replaced with a table bed 112 that is formed with an angularly offset cross-bar 106 coupling two lateral support sections 108 and 110. The table bed 112 is formed so that the cross-bar 106 is positioned at an angular offset 114 which coincides with position 68 of operating table 54. The angular offset 114 maintains the lateral support sections 108 and 110 in a horizontal orientation as shown in FIG. 6. Two support cushions 116 and 118 are positioned on the table bed 104 to support a patient 50 in a prone position. To move the patient between the prone position of FIG. 6 and a laterally angled position shown in FIG. 7, the cross-bar 106 is pivoted about axis 64 through an angle 120. The spine 72 of the patient 50 moves through an arc centered on the axis 64 similar to the movement of the spine 72 in the illustrative embodiment of FIGS. 4 and 5.

Figure 7:
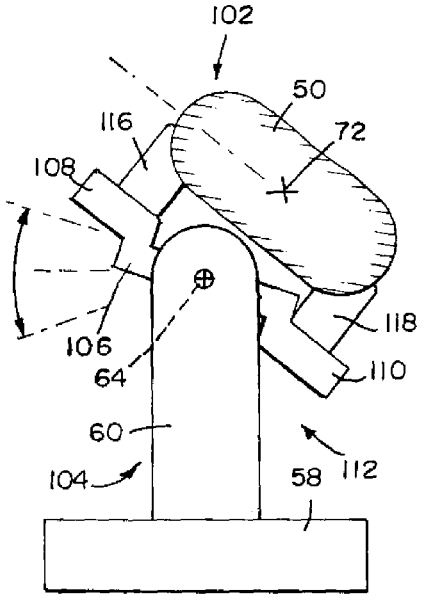
FIG. 7 is a diagrammatic representation of the surgical table in FIG. 6, with the table rotated about the horizontal axis to a second position suitable for laterally angled access to the spine of the human body.

Utilizing the structure of FIGS. 5 and 6, the cross-bar 106 is moved to a first position shown in FIG. 6 where the lateral support sections 108 and 110 are in a horizontal orientation. The support cushions 116 and 118 are positioned on the table bed 112. A patient 50 is positioned on the support cushions 116 and 118 in prone position. The table bed 112 is pivoted about the axis 64 to a second position as shown in FIG. 7. In the second position, which is a laterally angled position, anterior access to the spine 72 is available to the surgeon.

Figure 8:
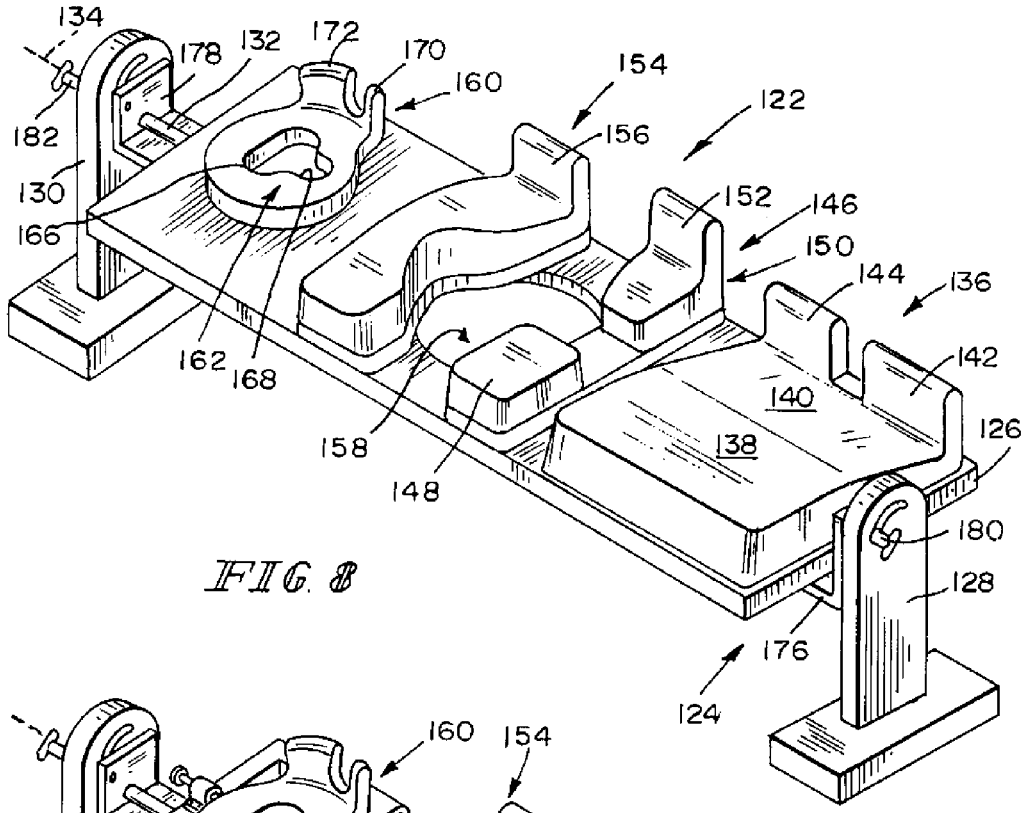
FIG. 8 is a perspective view of a surgical table including a typical table bed supporting a number of supports for supporting a human body in a prone position and a laterally angled position.
Figure 9:
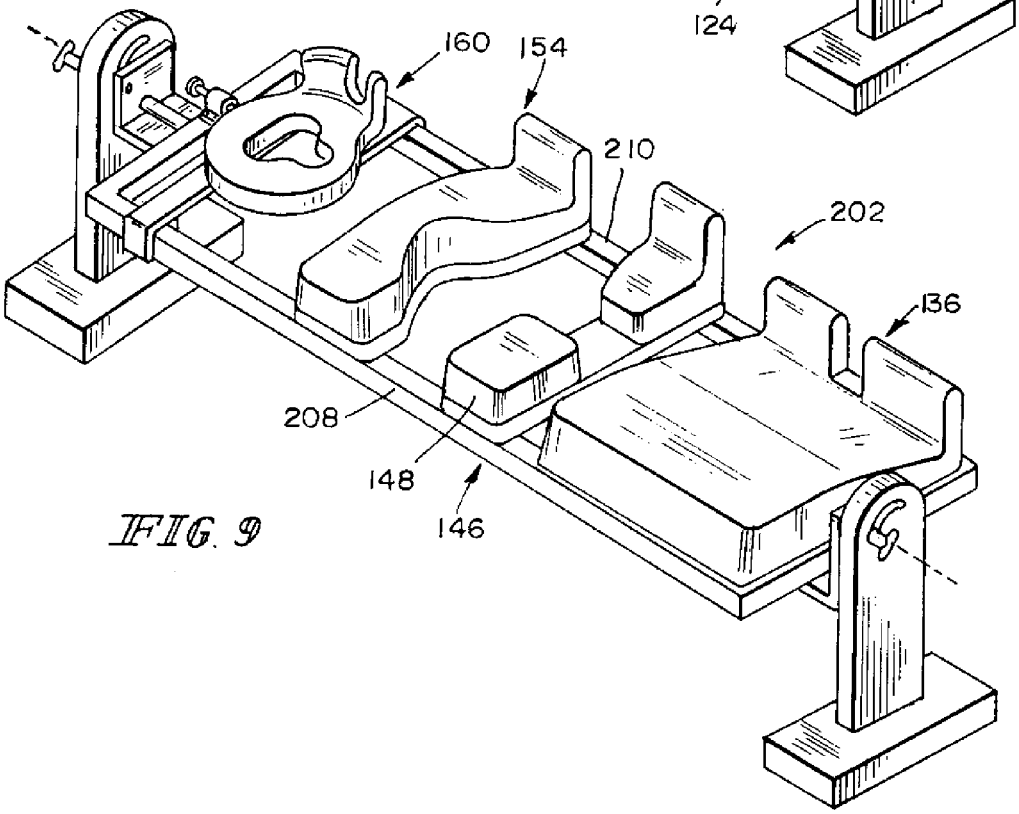
FIG. 9 is a perspective view of a surgical table including a pair of rails supporting a number of supports for supporting a human body in a prone position and a laterally angled position.

Referring now to FIG. 8, a patient support apparatus 122 includes an operating table 124 having a table bed 126 supported on a pair of pedestals 128 and 130. The tabled bed 126 pivots relative to the pedestals 128 and 130 on a pivot rod 132 and about a pivot axis 134. The patient support apparatus 122 further includes a leg support cushion 136 secured to the tabled bed 126 and configured to support the legs of a patient positioned on the patient support apparatus 122 in a prone position. The leg support cushion 136 includes an upper planar surface 138 and an angled planar surface 140 which extends from the surface 138. Two lateral support structures 142 and 144 extend from the surface 140 to provide lateral support to the legs of a patient supported on the leg support cushion 136 when the patient is positioned in a laterally angled position.

A pelvic support assembly 146 includes a left pelvic support cushion 148 and right pelvic support cushion 150. The cushions 148 and 150 are spaced apart to provide a gap between the cushions 148 and 150. The right pelvic support cushion 150 includes a lateral support structure 152 to provide lateral support to the pelvic region of a patient supported on the patient support apparatus 122 when the table bed 126 is positioned in a laterally angled position.

A chest support cushion 154 is also supported on the table bed 126 and is positioned to underlie the chest of a patient supported on the patient support apparatus 122. The chest support cushion 154 includes a lateral support structure 156 to provide lateral support to the chest of the patient when the table bed 126 is positioned in a laterally angled position. The table bed 126 includes an opening 158 positioned between the chest support cushion 154 and the pelvic support assembly 146. The opening 158 provides a space for the abdomen of a patient to hang freely during spinal surgery, thereby reducing compression on the spine of the patient in the prone position.

The patient support apparatus 122 also includes a face support 160 with an opening 162 that coincides with an opening 164 formed in the table bed 126. The opening 162 in the face support 160 includes an eye relief section 166 and a nose/mouth relief section 168, but engages the forehead, cheeks, and chin of a patient to support the patient's head in the prone position. The face support 160 includes two lateral support structures 170 and 172 with a space 174 formed therebetween. The space 174 provides relief for the ear of a patient supported on the face support 160. The lateral support structures 170 and 172 provide lateral support for the head of a patient supported on the patient support apparatus 122 when the table bed 126 is positioned in a laterally angled position. The lateral support structures 170 and 172 have a gap spaced between them to provide relief for the ear of a patient supported on the face support 160.

The patient support apparatus 122 further includes a pair of table supports 176 and 178. A pair of clamps 180 and 182, respectively, is each engaged with the table supports 176 and 178 and the pedestals 128 and 130 to clamp the table supports 176 and 178 to the pedestals 128 and 130 when the table bed 126 is pivoted about the axis 134. Once the table bed 126 is pivoted about axis 134 to a new position, clamps 180 and 182 are tightened to retain the table bed 126 in the new position.

A patient support apparatus 202 is similar to the patient support apparatus 122, with the table bed 126 of patient support apparatus 122 omitted and replaced by a frame 206. The frame 206 includes two lateral rails 208 and 210 with two cross-bars 212 and 214 securing the lateral rails 208 and 210 together. The lateral rails 208 and 210 are carbon fiber components with the leg support cushion 136, pelvic support assembly 146, chest support cushion 154, and face support 160 all supported from the rails 208 and 210.

In some embodiments, the left pelvic support cushion 148 may be removable when the frame 206 or table bed 126 is moved to a laterally angled position. With the pelvic support cushion 148 removed, the surgeon has improved access to the anterior of the patient spine when the frame 206 or table bed 126 are in the laterally angled position.

Figure 10:
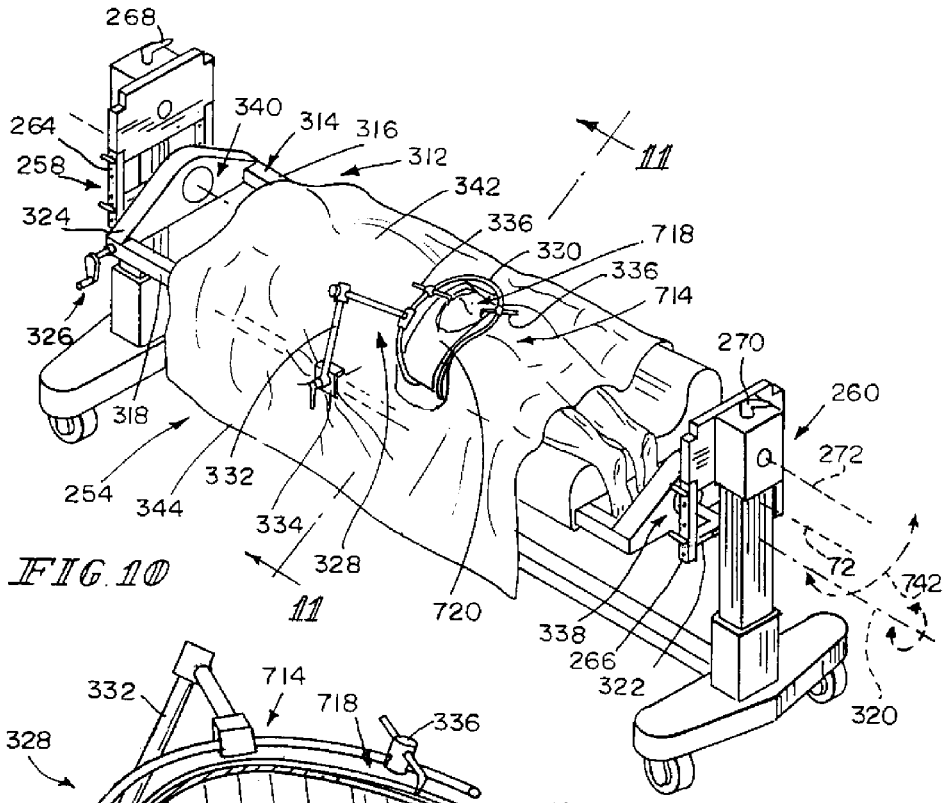
FIG. 10 is a perspective view of a surgical table similar to the surgical table of FIG. 10 and further including a separate rotator supported on the rack to rotate the offset frame relative o the rotation axis of the surgical table.
Figure 11:
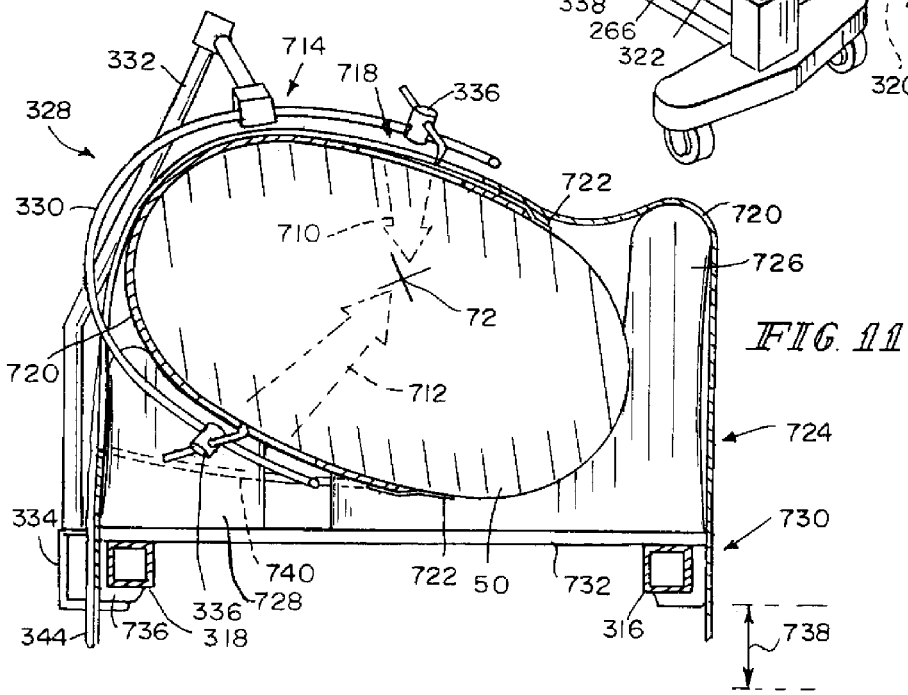
FIG. 11 is a cross-sectional view taken along lines 11-11 in FIG. 10.
Figures 12, 13:
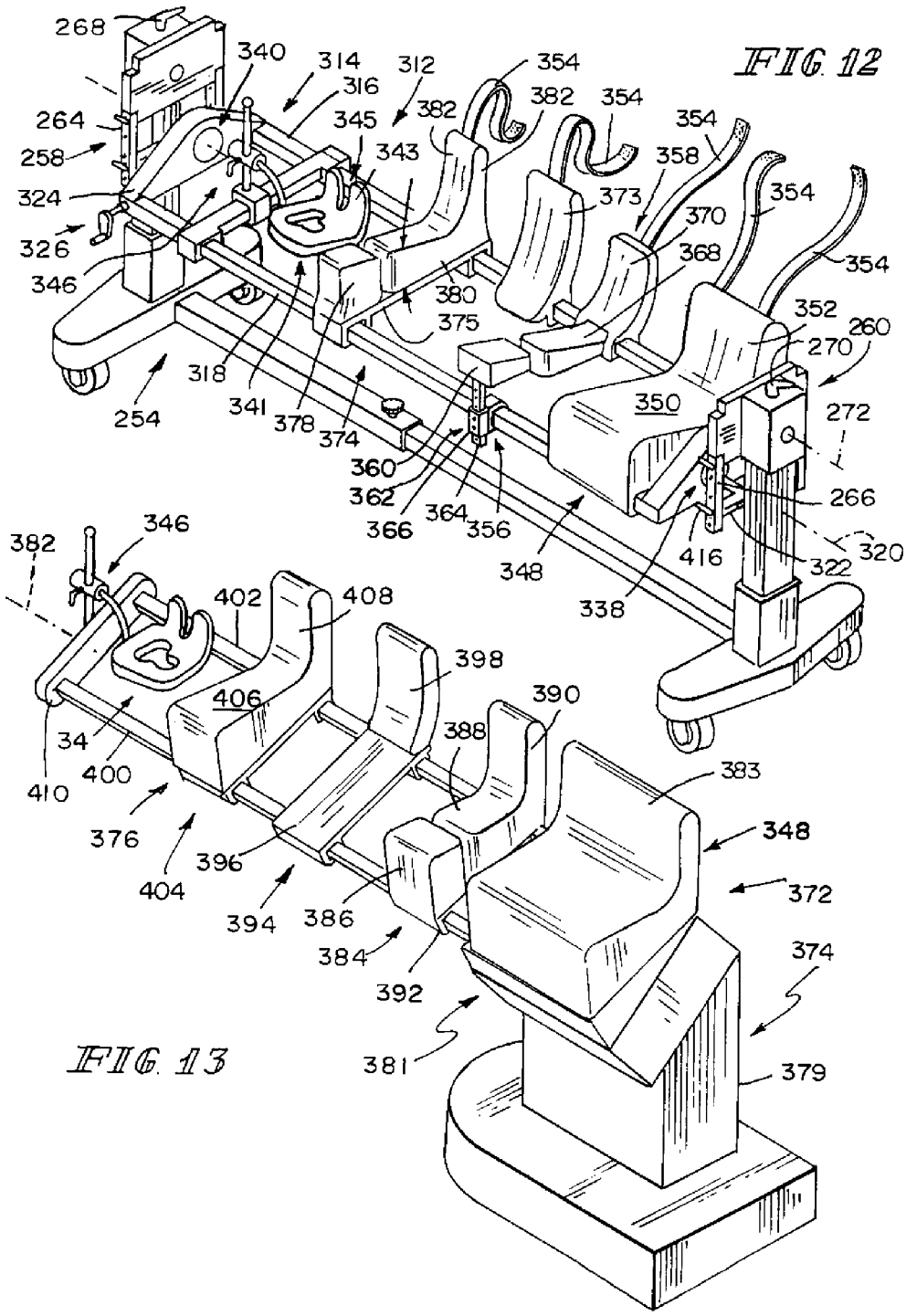
FIG. 12 is a perspective view of the surgical table of FIG. 10 with portions removed.
FIG. 13 is a perspective view of an operating table having a spinal frame secured to the operating table.

Another embodiment of a patient support apparatus 312, shown in FIGS. 10-12, includes an illustrative operating table 254 which is a Jackson Spinal Table available from Mizuho OSI of Union City, Calif. A frame 314 is supported from the table 254. The frame 314 includes generally parallel lateral rails 316 and 318. The frame 314 also includes a driver 340 at one end and a bearing 338 at the opposite end. The driver 340 is enclosed in a housing 324 and includes a handle 326 which is operable to cause portions of the frame 314 to rotate about an axis 320 to move a patient 50 between a prone position and a laterally angled position.

Figure 14:
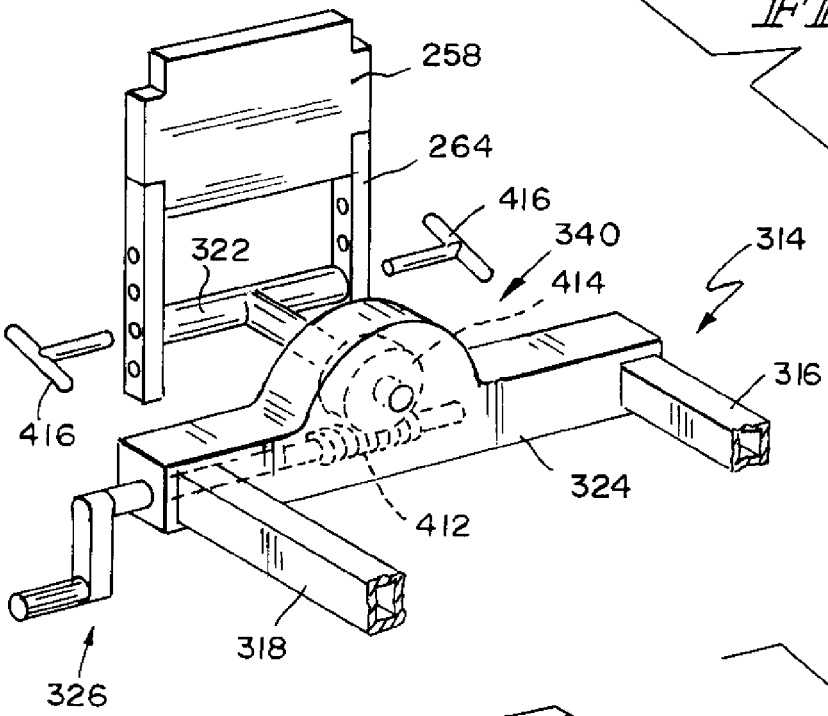
FIG. 14 is a perspective view of portion of a patient support apparatus including a driver for rotating a portion of the patient support apparatus about a longitudinal axis.

As shown in FIG. 14, the driver 340 includes a worm gear 412 coupled to the handle 326 and secured to the moving portions of the frame 314. The frame 314 includes adapters 322 to allow the frame 314 to be supported from the racks 264 and 266 of the operating table 254. The adapters 322 are secured to the racks 264 and 266 by a pair of connectors 416 at each end. A spur gear 414 is coupled to the adapter 322 at the driver 340 end. As the handle 326 is turned, the action of the worm gear 412 on the spur gear 414 causes the frame 314 to rotate about the axis 320. The pitch of the gears 412 and 414 is such that the frame 314 is maintained in position through the frictional resistance of the gears 412 and 414. In some embodiments, a lock may be included to prevent rotation of the frame 314 when the frame 314 is in procedural position. The end of the frame 314 opposite the driver 340 is supported from the bearing 338 which permits free rotation of the bearing 338 end during rotation of the frame 314.

Figure 15:
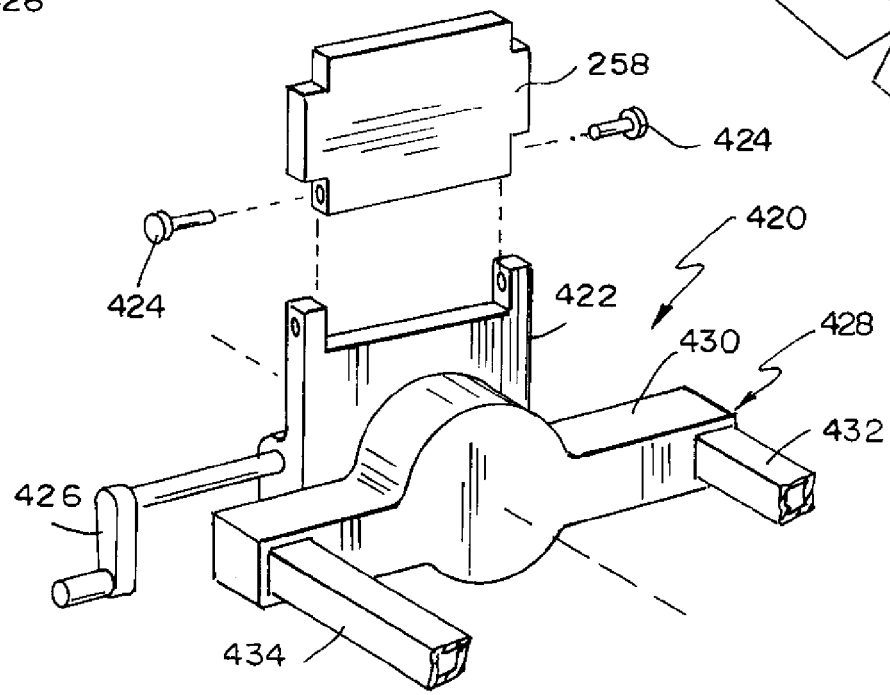
FIG. 15 is a perspective view of portion of a patient support apparatus including a driver for rotating a portion of the patient support apparatus about a longitudinal axis.

Referring now to FIG. 15, another embodiment of a driver 420 is similar to the driver 340, but the gearing mechanisms are positioned in a housing 422 which is secured directly to the pedestal 258 of the operating table 254 and the racks 264 and 266 are omitted. The driver 420 includes a handle 426 which turns a worm gear (not shown) in a manner similar to the manner in which driver 340 operates. The driver 420 is not part of the frame 428 of the embodiment of FIG. 15, but the frame 428 is supported from the spur gear so that the frame 428 turns about an axis 436 relative to the driver 420. The driver 420 is secured to the pedestal 258 via a pair of fasteners 424. The frame 428 includes a cross-bar 430 and a pair of laterally spaced apart rails 432 and 434. Because the driver 420 is not supported on the frame 428, the handle 426 stays in a horizontal orientation at all times and the weight of the driver 420 is not borne by the frame 428.

Referring again to FIGS. 10 and 11, a drape 342 positioned over the patient 50 and allows the patient 50 to be repositioned without breaking the sterile field. The drape 342 is positioned so that a flap 344 of the drape 342 is positioned to fold under the rail 318 when the frame 314 is pivoted to the laterally angled position. A retraction support assembly 328 is positioned to allow the anterior and posterior surgical site(s) to be retracted during all phases of the surgical procedure. The retraction support assembly 328 includes a support arm 332 that supports a frame 330 from the rail 318. A clamp 334 is used to clamp the support assembly 328 to the rail 318. The retraction frame 330 is shaped to overlie both the posterior approach site and the anterior lateral approach site at all times, thereby allowing the surgeon to apply retractors 336 to both sites simultaneously so that the surgeon may access both sites by simply moving the frame 314 between a prone position and a laterally angled position.

The drape 342 includes a large opening 714 of sufficient size to overlie both the anterior and posterior approach sites. The patient 50 is supported in an angled orientation relative to the frame 314 and rails 316 and 318 by a body support 724. The body support 724 includes a cushion 728 having a lateral support structure 726 and formed to position a patient in a partially laterally angled position. The body support 724 further includes a substrate 732 and a pair of couplers 730 and 736 which secure the body support 724 to the frame 314.

In the illustrative embodiment, an inner drape 720 is positioned on the patient 50 to wrap around the patient's abdomen and provide sterile field. The inner drape includes an anterior access hole 716 and a posterior access hole 718. The inner drape is secured to the patient 50 by adhesive strips 722. When the frame 314 is deviated to place the patient 50 in a prone position, the surgeon makes a posterior approach as indicated by arrow 710 through the posterior access hole 718. When the patient 50 is positioned in a laterally angled position with the frame 314 rotated about the horizontal axis about 60 degrees to raise the rail 318 above the rail 316, the surgeon makes an anterior approach as indicated by arrow 712 through the anterior access hole 716.

For example, the surgeon may rotate the frame 314 about axis 320 to place the patient in a laterally angled position. The surgeon may also rotate the patient supporting structure about the axis 272 such that the axis 320 orbits the axis 272 as indicated by arrow 742.

In some embodiments, the drapes 342 and 720 may be integrally formed with a flap 740 shown in phantom in FIG. 11 spanning the gap between the rail 318 and the lower adhesive strip 722 to enclose the anterior approach completely in a sterile garment. By placing the patient on the apparatus 312 as discussed, the area below the abdomen of the patient is completely open allowing the abdomen to hang freely. In addition, the space below the frame 314 is open for fluoroscopy or other imaging access as indicated by the arrow 738 in FIG. 11.

Referring now to FIG. 12, drape 342 is removed and the patient supports mounted on the rails 316 and 318 are visible. A face support 341 is similar to face support 160 and is supported from a positioner 346. The face support 341 includes a pair of lateral support structures 343 spaced apart to form a relief space 345 for a patient's ear. A foot support cushion 348 includes an inclined support surface 350 and a lateral support structure 352. A pair of straps 354 is attached to the lateral support structure 352 and is used to secure a patient to the foot support cushion 348 to secure the patient when the frame 314 is moved to the laterally angled position. In the illustrative embodiment, the straps 354 include hook and loop fasteners to secure the straps 354. In other embodiments, the straps 354 may include buckles or other structures to secure the straps 354 to retain a patient on the foot support cushion 348. In FIG. 12, the surface 350 is at an incline and the frame 314 is positioned in a horizontal orientation. In use, the frame 314 would be rotated about the axis 320 to position the surface 350 in a horizontal orientation so that a patient would be supported in a prone position. The frame 314 would then be rotated about axis 320 by the driver 340 to position the patient in the laterally angled position, permitting access to the anterior of the spine via the pelvic approach discussed above.

The pelvic area of the patient is supported on two pelvic supports 356 and 358. The pelvic support 356 includes a cushion 360 having an inclined upper surface. The cushion 360 is supported on a stem 364 of a locator 362. The locator 362 also includes a collar 366 which receives the stem 364 with the stem 364 movable relative to the collar 366 to vary the position of the cushion 360 vertically relative to the rail 318. The cushion 360 may be lowered when access to the pelvic region is required during the anterior approach to the spine in the laterally angled position. The collar 366 includes a clamp (not shown) which allows the pelvic support 356 to be clamped to the rail 318. The pelvic support 356 may be movable along the rail 318 to move the pelvic support 356 out of the way when the anterior approach is made in the laterally angled position.

The pelvic support 358 includes a cushion 368 that is cantilevered from the rail 316 and a lateral support structure 370 which supports the pelvic region of the patient when the patient is in the laterally angled position. The pelvic support 358 also includes a strap 354 for securing the pelvic region of the patient.

In the embodiment of FIGS. 11 and 12, there is no abdominal support of the patient in the prone position. A lateral support structure 373 supports the patient's side when the patient is positioned in the laterally angled position. A chest support 374 includes a support plate 375 and two support cushions 378 and 380 which move relative to one another on the support plate 375. Movement of the cushions 378 and 380 allows the chest support 374 to be adjusted for patients of different widths. The cushion 380 includes a lateral support structure 383 and a strap 354 for supporting and securing a patient in a laterally angled position.

A method of performing a spinal surgical procedure on the patient support apparatus 312 includes positioning the frame 314 in a deviated position and positioning a number of supports on the frame 314 to support a patient in a prone position for access to the posterior of the spine. The frame 314 is then moved from the first deviated position to a second position in which the frame 314 is rotated about a longitudinal axis to a deviated position opposite the first such that the patient is in a laterally angled position. A pelvic support 356 is then adjusted to permit access to the pelvic area of the patient for approach to the anterior of the patient's spine. The repositioning according to this method does not require the sterile field to be broken while the patient is repositioned.

While the operating table 254 is well know for use as a spinal surgery patient support apparatus, another embodiment of a patient support apparatus 372 suitable for use in spinal surgeries includes an operating table 374 with a spinal frame 376 cantilevered from the top of the operating table 374 as shown in FIG. 13. The pedestal 379 of the operating table 374 is powered to allow the position of the table bed 381 and the spinal frame 376 to be moved to a deviated position as shown in FIG. 13. In the illustrative patient support apparatus 372, the table bed 381 has been modified with several members of the standard table bed removed to allow the spinal frame 376 to be attached to the operating table 374. Drive mechanisms (not shown) within the table allow the table bed 381 and spinal frame 376 to be rotated about an axis 382. A leg support cushion 348 is positioned on the table bed 381. A patient may be secured to the leg support cushion 348 via straps 354 (not shown) or other suitable restraint.

A pelvic support assembly 384 includes a left pelvic support 386 and a right pelvic support 388. The left pelvic support 386 is removable to allow access to the pelvic region when the patient is moved to the laterally angled position. The right pelvic support 388 includes a lateral support structure 390. The surfaces of the left pelvic support 386 and the right pelvic support 388 are formed at an angle relative to a base 392 so that when the pedestal 379 of the operating table 374 is deviated about axis 382 as shown in FIG. 13, the surfaces form a planar surface suitable for supporting a patient in a prone position.

An abdominal support structure 394 includes a base 396 and a lateral support 398. The base 396 is supported on two rails 400 and 402 of the spinal frame 376. The abdominal support structure 394 does not engage the anterior of the abdomen when the patient is in the prone position so that the abdomen hangs free, reducing compression on the spine. An angled chest support 404 includes an angled surface 406 and a lateral support structure 408. The patient support apparatus 372 further includes a face support 341 which is supported from a positioner 346.

A method of spinal surgery utilizing a patient support apparatus 372 includes positioning a spinal frame 376 on the operating table 374. A number of angled support cushions are positioned on the spinal frame 376 and operating table 374. The operating table 374 is deviated such that the angled support cushions present a generally horizontal support structure suitable for supporting a patient in a prone position. The posterior of the spine is accessed in the prone position. The operating table 374 is actuated to rotate the spinal frame 376 about the axis 382 which is maintained in a generally horizontal orientation. The rotation of the operating table 374 and spinal frame 376 results in the patient being positioned in a laterally angled position. The left pelvic support 386 is removed to permit access to the anterior of the spine through a pelvic approach.

Figure 16:
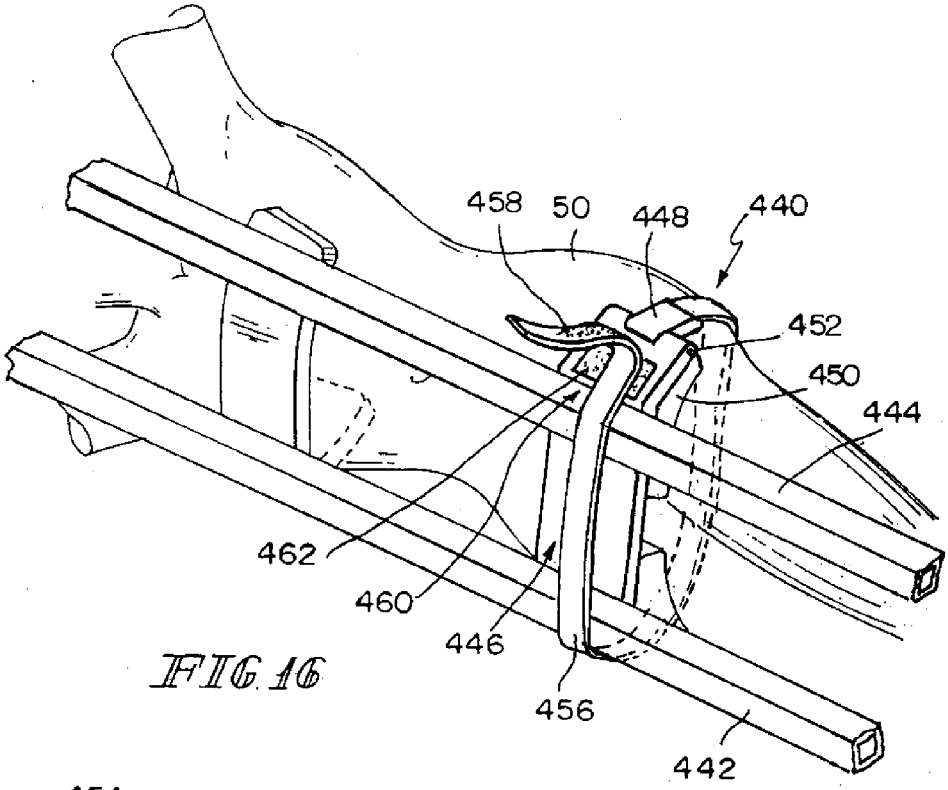
FIG. 16 is a bottom view of a portion of a patient supported on a pair of laterally spaced longitudinal rails with a restraint device securing the patient.
Figure 17:
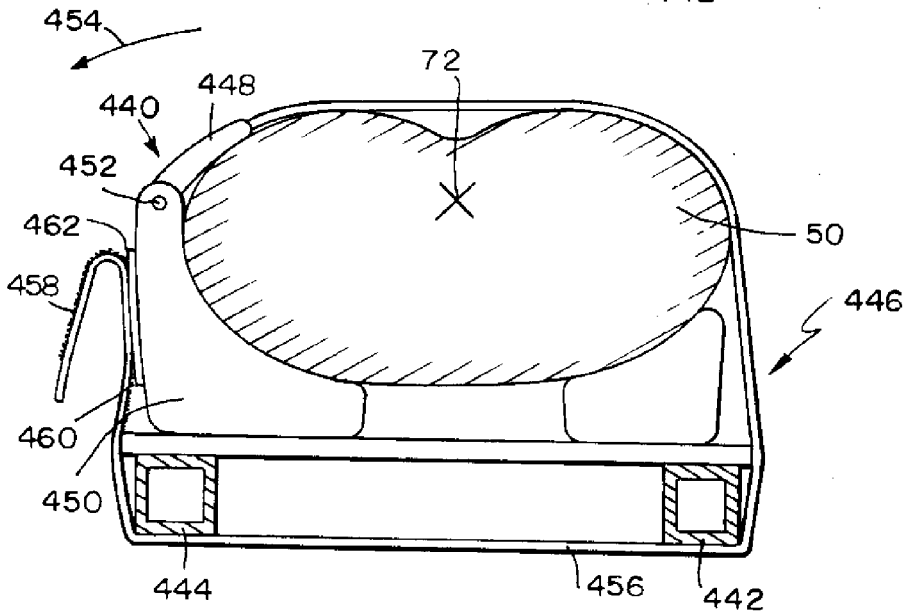
FIG. 17 is an end cross-section of the restraint device of FIG. 16.

An embodiment of a restraint 440 which may be adapted to the various cushions and support structures disclosed above is shown in FIGS. 16 and 17. In FIG. 16, a bottom view of a patient 50 supported on a support apparatus including a pair of lateral rails 442 and 444 shows the restraint 440 pivotably coupled to a pelvic support assembly 446. The restraint 440 includes a pivoting arm 448 that is hinged to a left pelvic support 450 of the pelvic support assembly 446 through a pin 452. The restraint 440 includes a strap 456 that includes a first part 458 of a two-part hook and loop fastening system. A pad 460 that includes the second part 462 of the two-part hook and loop fastening system engages the first part 458 to secure the strap. When a patient is rotated to a laterally angled position as indicated by the arrow 454, the restraint 440 and pelvic support 450 provide support for the body of the patient 50 in a laterally angled position.

Figure 18:
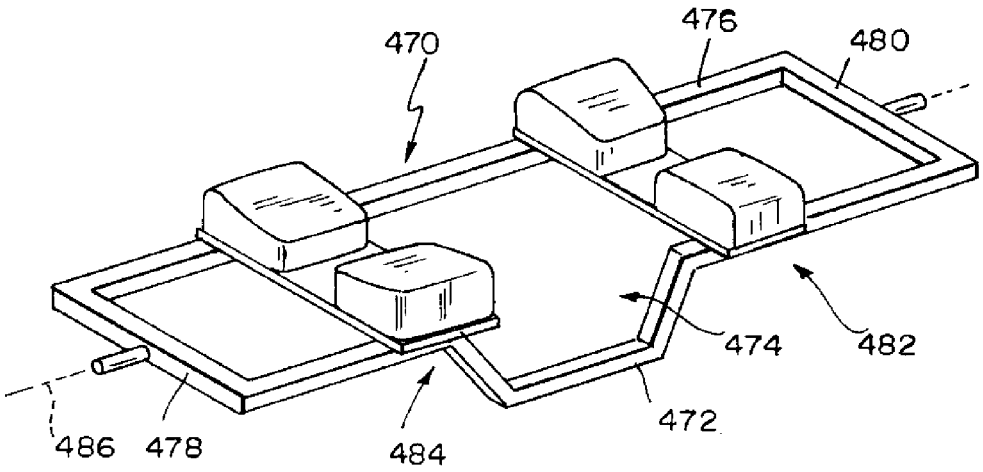
FIG. 18 is perspective view of an embodiment of a patient supporting frame of a patient support apparatus.

In some embodiments, the frames of the support apparatuses discussed above may be omitted and replaced with a modified frame. For example, a frame 470 shown in FIG. 18 has been modified such that a lateral rail 472 is formed to be spaced apart from the body of the patient forming a space 474 to provide improved access to the upper pelvic region of the patient when the frame 470 is rotated to place the patient in a laterally angled position. The frame 470 includes a second lateral rail 476 and two cross-bars 478 and 480. The frame 470 is shown supporting a pelvic support assembly 482 and a chest support assembly 484 and is rotatable about an axis 486.

Figure 19:
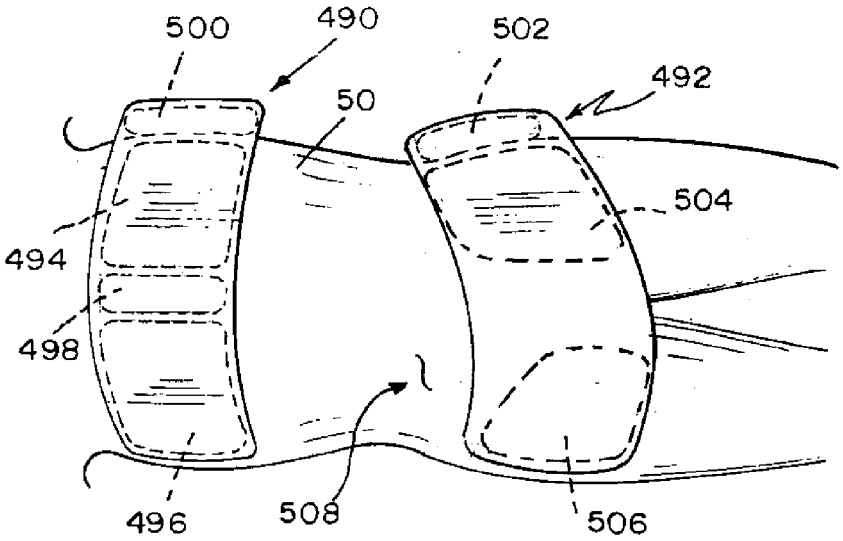
FIG. 19 is a view of a portion of a patient with pre-applied cushions.

In the embodiment of FIG. 19, a chest cushion 490 and a pelvic cushion 492 are positioned directly on the patient 50 to provide additional cushioning of the patient during spinal surgery. The chest cushion includes two separate breast pads 494 and 496 as well as a sternum pad 498. A lateral chest pad 500 is positioned to cushion the side of the chest of the patient 50 when the patient 50 is supported in a laterally angled position. The pelvic cushion 492 includes a lateral pad 502 and a first pelvic pad 504. A second pelvic pad 506 is sized and configured to support the pelvis of the patient 50 lower than the pelvic pad 504 to provide relief for a surgeon to access a surgical site 508 in the upper pelvic, lower abdominal area for anterior access to the spine. It is contemplated that cushions such as chest cushion 490 and pelvic cushion 492 may be applied prior to placing the patient 50 on a support apparatus so that the cushions may be properly placed without need for detailed adjustment of support structures on the patient support apparatus.

Figure 20:
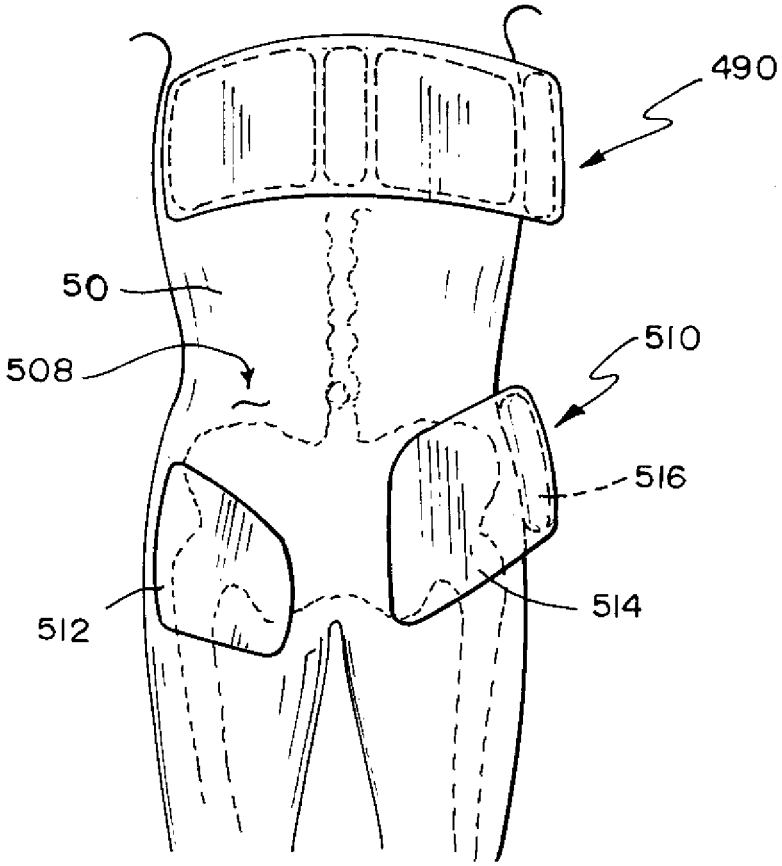
FIG. 20 is a view of a portion of a patient with pre-applied cushions.

As shown in FIG. 20, the pelvic cushion 492 may be omitted and replaced with two separate cushions 510 and 512. The pelvic cushion 510 includes a left pelvic pad 514 and a lateral pelvic pad 516. The separate cushion 512 is positioned on the right pelvic region and is spaced apart from the surgical site 508.

Figure 21:
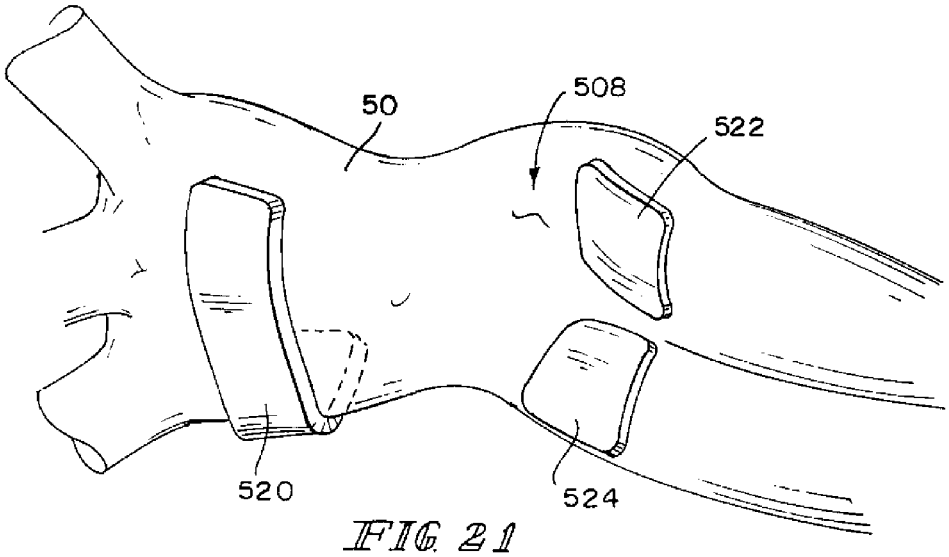
FIG. 21 is a view of a portion of a patient with pre-applied cushions.
Figure 22:
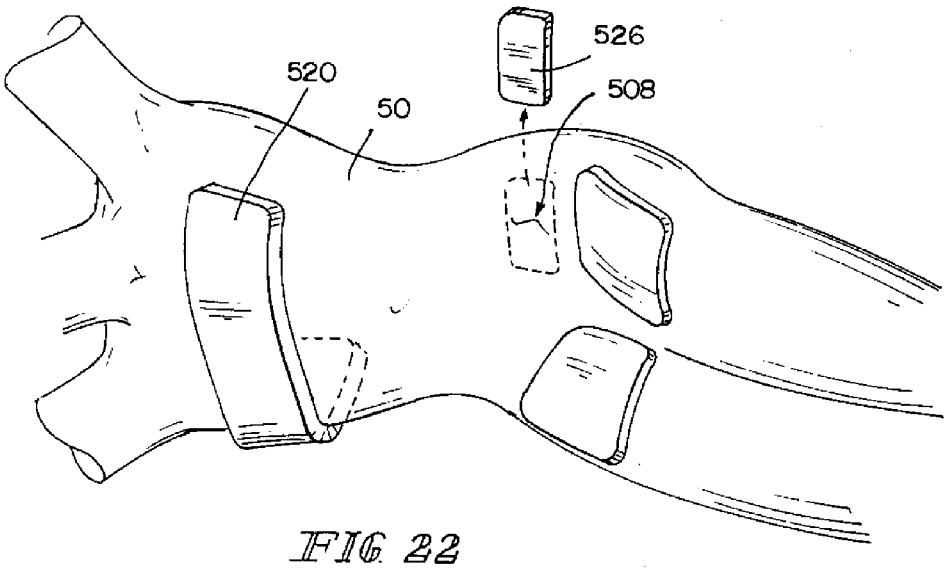
FIG. 22 is a view of a portion of a patient with pre-applied cushions.

In the embodiment of FIGS. 21 and 22, the patient 50 is shown in a laterally angled position with the patient's left upper pelvic region presented for access to the anterior of the spine. A single cushion 520 is applied to the chest of the patient and wraps around the side of the patient 50 and provides cushioning in both the prone and laterally angled positions. Two pelvic cushions 522 and 524 are applied to the left and right pelvic areas respectively. The surgical site 508 is exposed in the laterally angled position; with a surgical site cushion 526 applied to the surgical site when the patient 50 is rotated back to the prone position.

Body supports for supporting the patient during spinal surgery may include many variations including those shown in U.S. Pat. No. 7,600,281 which is incorporated by reference herein. Variations of the body supports applicable to various patient support apparatuses that are movable to a laterally angled position are disclosed further herein and should be understood to be applicable to frames having spaced-apart rails as well as traditional surgical table tops.

Figure 23:
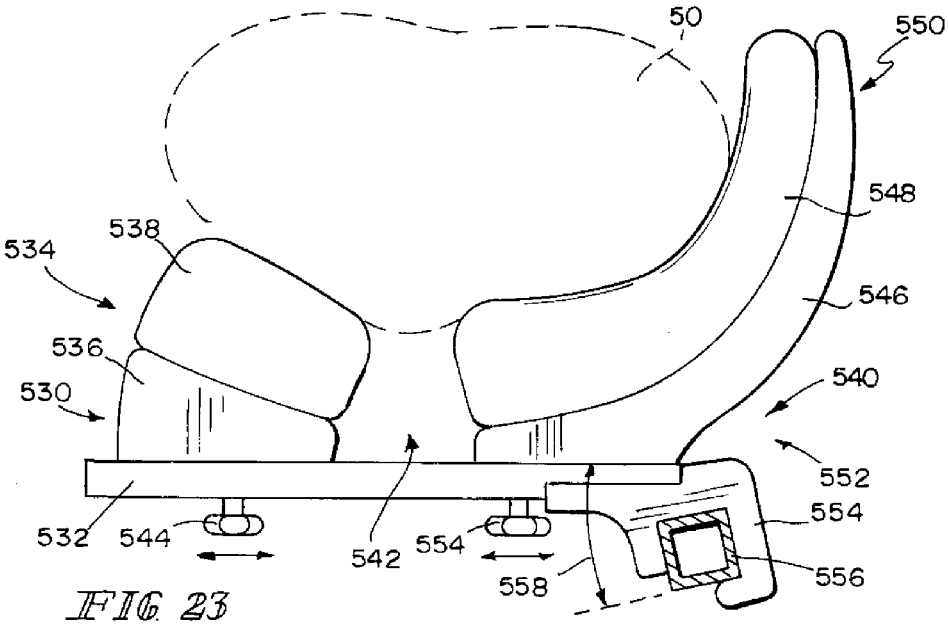
FIG. 23 is an end view of a body support positioned on a rail of a patient support apparatus.

For example, an embodiment of a body support 530 shown in FIG. 23 includes a cross-member 532 and a first support 534 movable relative to the cross-member 532. The first support 534 includes a base 536 and a cushion 538 supported on the base 536 and having an upper surface that is angled to support the side of a patient in a prone position as shown in FIG. 23. A second support 540 is also secured to the cross-member 532 and movable relative to the cross-member 532. The first support 534 and second support 540 are spaced apart so that a gap 542 is formed therebetween. The second support 540 includes a base 546 and a cushion 548. The base 546 and cushion 548 both are formed to included a lower portion 552 which supports the patient in the prone position, and a lateral portion 550 which provide lateral support to the patient in the laterally angled position. The cross-member 532 is cantilevered from a coupler 554 which secures the body support 530 to a rail 556 of a patient support apparatus. The body support 530 includes locks 544 secured to each of the first support 534 and second support 540 respectively. The locks 544 may be released to move the first support 534 or second support 540 along the cross-member 532. The cross-member 532 is secured to the coupler 554 at an angle 558. When the frame of a patient support apparatus is deviated at the angle 558 as depicted by the rail 556 in FIG. 23, the first support 534 and second support 540 present a support structure that is suitable for supporting the patient 50 in a prone position.

Figure 24:
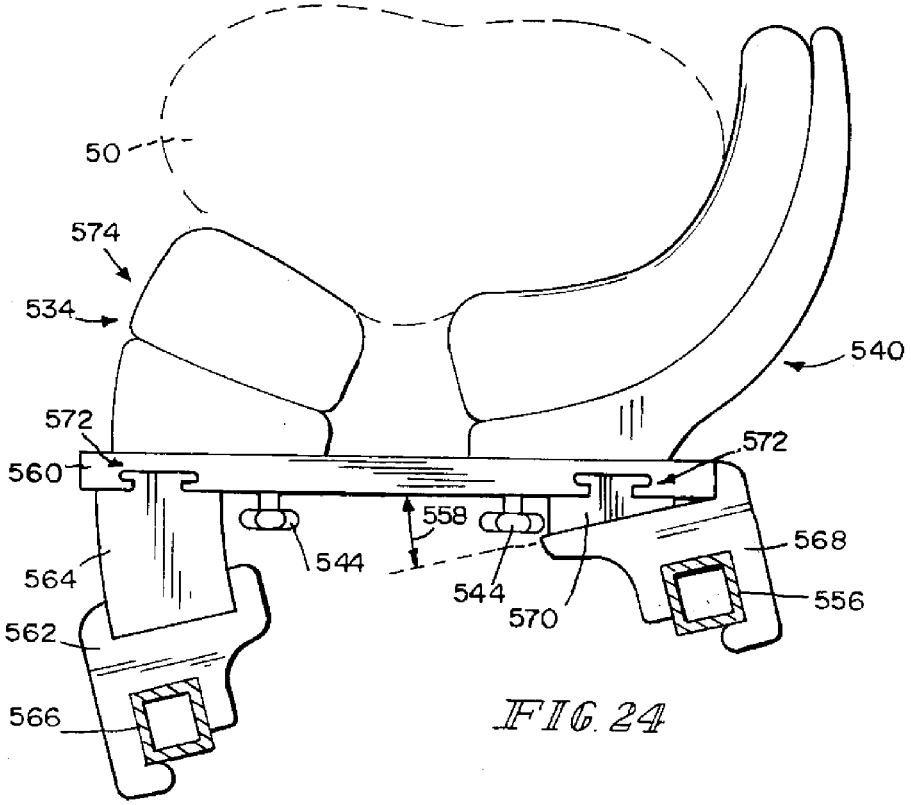
FIG. 24 is an end view of another embodiment of a body support positioned on the rails of a patient support apparatus.

Another embodiment of a body support 574 shown in FIG. 24 includes the first support 534 and second support 540. However, the cross-member 532 of body support 530 has been omitted and replaced with a cross-member 560. Cross-member 560 includes two t-slots 572 which receive respective spacers 564 and 570. The body support 574 also includes a pair of couplers 562 and 568 which couple the body support 574 to respective rails 566 and 556 of a patient support apparatus. The spacers 564 and 570 are secured to the respective couplers 562 and 568 such that the cross-member is positioned at an angle 558 relative to the rails 566 and 556. Thus, when the patient support apparatus is deviated by an angle 558, as shown in FIG. 24, the first support 534 and second support 540 present a support structure that is suitable for supporting the patient 50 in a prone position.

Figure 25:
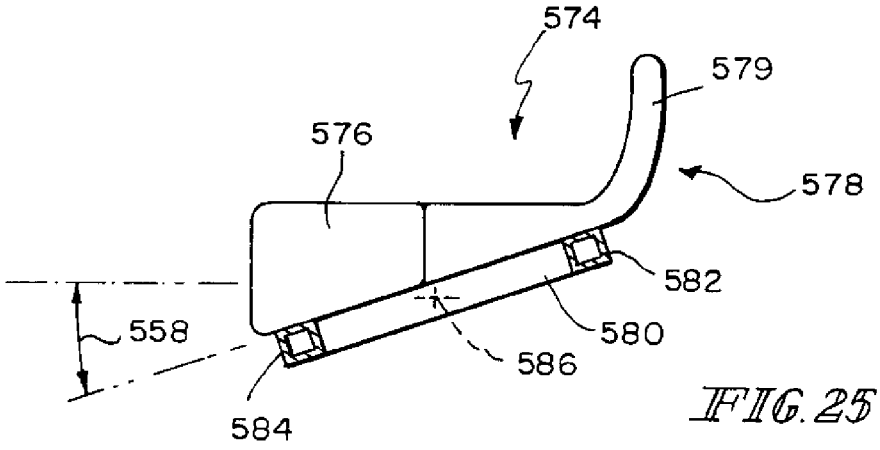
FIG. 25 is an end view of yet another embodiment of a body support positioned on the rails of a patient support apparatus.

FIG. 25 shows an embodiment of a body support 574 coupled directly to a frame 580 of a patient support apparatus. The body support 574 includes a first cushion 576 and a second cushion 578 that includes a lateral support structure 579. The frame 580 includes laterally spaced rails 582 and 584. As shown in FIG. 25, the frame 580 is deviated by an angle 558 which results in the upper surfaces of the cushions 576 and 578 being oriented to provide a horizontal surface suitable for supporting a patient in a prone position. Rotation of the frame 580 about a central longitudinal axis 586 results in the patient being positioned in a laterally angled position with the lateral support structure 579 supporting the patient.

Figure 26:
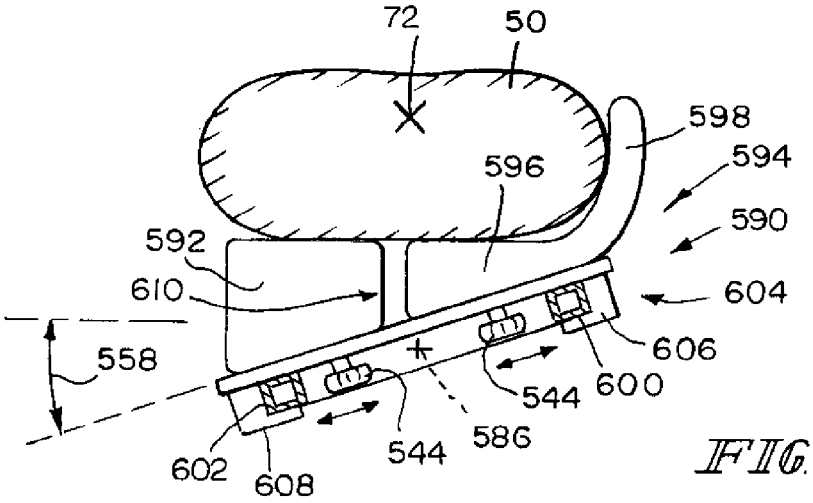
FIGS. 26-27 are end views of still yet another embodiment of a body support positioned on the rails of a patient support apparatus.
Figure 27:
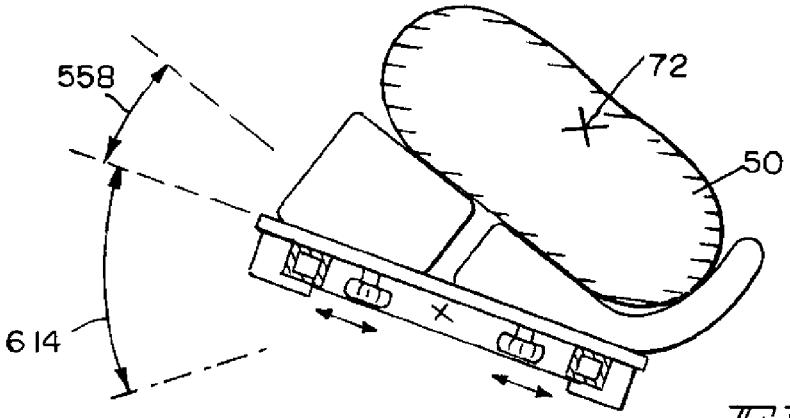

In yet another embodiment shown in FIGS. 26 and 27, a body support 590 includes a first support 592 and a second support 594 which are both movable relative to a cross-member 612 and are locked to the cross-member 612 by a respective lock 544. The second support 594 includes a prone support 596 and a lateral support 598. The cross-member 612 is secured to a pair of couplers 606 and 608 which couple the body support 590 to a pair of laterally spaced rails 600 and 602 respectively. When the rails are deviated from horizontal by an angle 558, the surface of the first support 592 and the prone support 596 of the second support 594 present a surface suitable for supporting a patient 50 in a prone position as shown in FIG. 26. When the rails 600 and 602 are rotated about the axis 586 by an angle 614 as shown in FIG. 27, the lateral support 598 supports the patient in a laterally angled position and the anterior of patient's spine 72 is accessible through an upper pelvic anterior approach.

Figure 28:
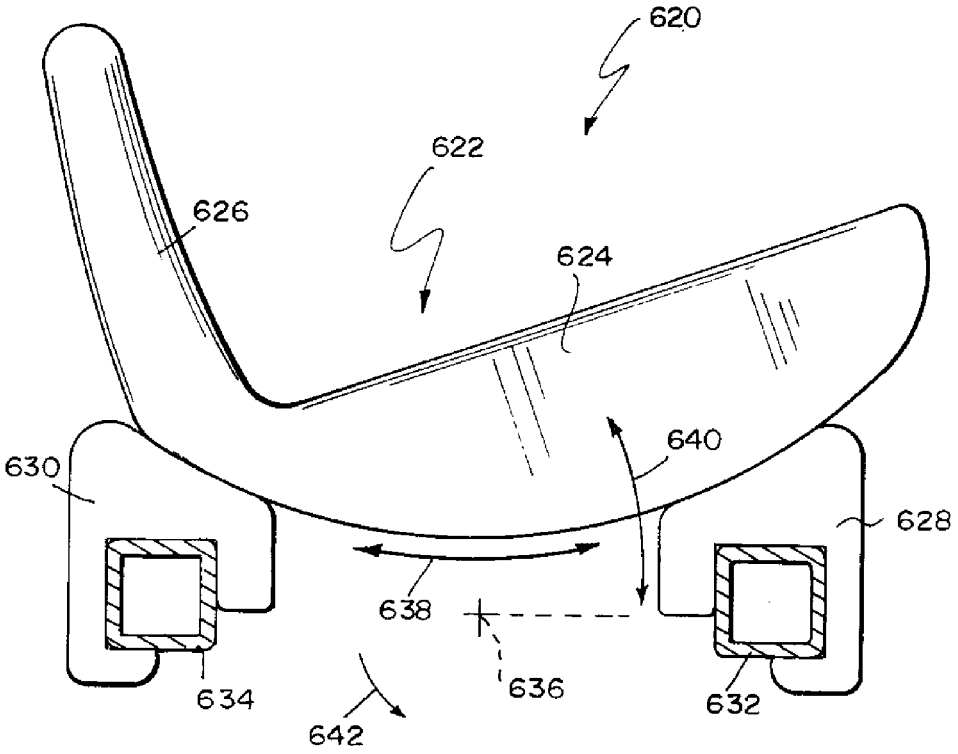
FIG. 28 is an end view of still another embodiment of a body support positioned on the rails of a patient support apparatus.

In still yet another embodiment of a body support 620 shown in FIG. 28, the body support 620 includes unitary support body 622 having a prone support 624 and a lateral support 626. The support body 622 is secured to a pair of couplers 628 and 630 which couple the body support 620 to laterally spaced rails 632 and 634 of a patient support apparatus. If the rails 632 and 634 are deviated about a longitudinal axis 636 by an angle 640, the prone support 624 is positioned to provide a horizontal surface for supporting a patient in a prone position. Deviation of the rails 632 and 634 in the direction of arrow 642 results in the patient being supported in a laterally angled position. In some embodiments, the support body 622 is movable relative to the couplers 628 and 630 as shown by arrow 638 to change the orientation of the support body 622 relative to the rails 632 and 634. In such an embodiment, the deviation from horizontal to the laterally angled position of the patient is accomplished by moving the support body 622 relative to the rails 632 and 634 without need for deviation of the patient support apparatus from horizontal.

Figure 30:
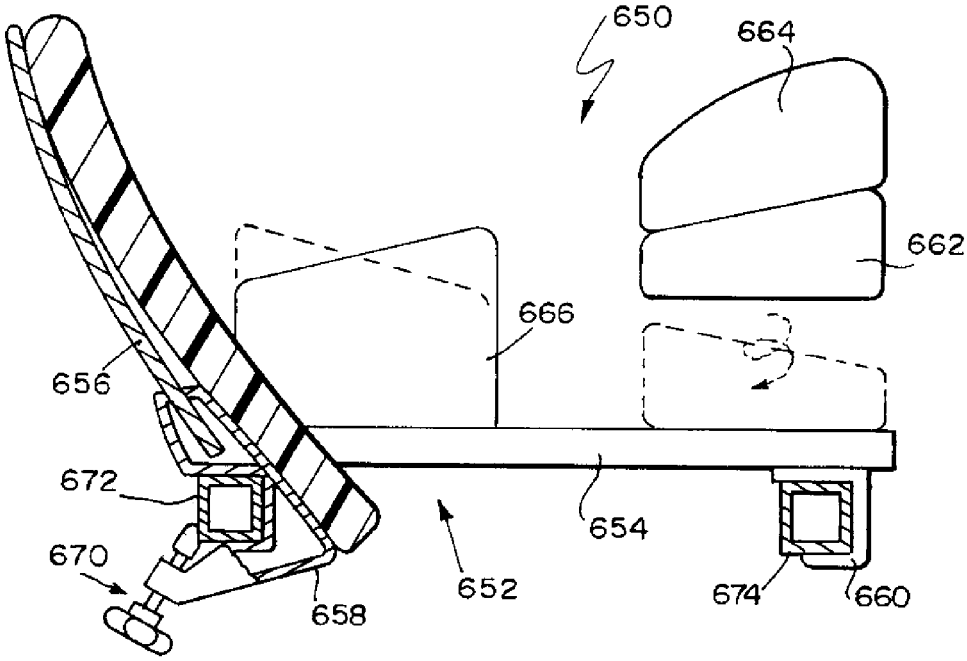
FIG. 30 is a partial cross-sectional view of another embodiment of a body support.

In another embodiment of a body support 650 shown in FIG. 30, a frame 652 of the body support 650 includes a cross-member 654, a lateral support structure 656, and a coupler 658. The frame 652 further includes a coupler 660 positioned opposite the coupler 658. The frame 652 supports a first support 662 supporting a first cushion 664 and a second cushion 666. Both the first support 662 and second cushion 666 are movable to change an orientation of the cushions 666 and 664. The lateral support structure 656 supports a cushion 668. A clamp 670 is engaged with the coupler 658 to secure the body support 650 to a rail 672 of a patient support apparatus. The coupler 660 engages with a second rail 674 of the patient support apparatus.

A lateral support 680 shown in FIG. 2 includes a solid body 682 with a lateral support 684 and a coupler 686 which is received on a rail 688 of a patient support apparatus. The lateral support 680 further includes a clamp 690 engaged with the coupler 686 and adjustable to secure the lateral support 680 to the rail 688.

Another lateral support 692 includes a coupler 694, a support arm 696 secured to the coupler 694, and a cushion assembly 698 coupled to the support arm 696. The cushion assembly 698 includes a pad 700 supported on a contoured support 706. The lateral support 692 is secured to a rail 702 of a patient support apparatus by a clamp 704 that engages the coupler 694 and the rail 702 to lock the lateral support 692 to the rail 702.

Figure 29:
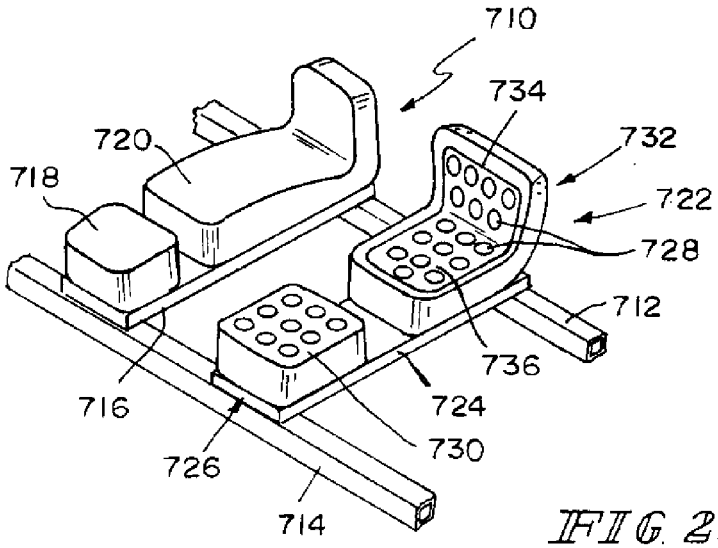
FIG. 29 is a perspective view of a portion of a patient support apparatus including two body supports.

Referring now to FIG. 29, it should be understood that any of the cushions, pad, or supports disclosed herein may comprise open or closed-cell foam or a rigid radiolucent material. The body support 710 coupled to a pair of lateral rails 712 and 714 includes a radiolucent cross-member 716 with two foam cushions 718 and 720. In other embodiments, the foam may be omitted and replaced with a gel material or gel structures may be interspersed in the foam. For example, the body support 722 includes a radiolucent cross-member 724 supporting a cushion 726 having a number of gel cells 728 positioned in foam 730. The cushion 732 includes a rigid foam perimeter 734 enclosing lower density foam 736 with a number of gel cells 728 position in the foam 736.

It should be noted that while various embodiments of body supports, lateral supports, cushion structures, and restraints have been disclosed in various embodiments, the scope of the disclosure includes the interchangeability of the various elements and adaptation of the structures to patient support apparatuses of various configurations.

Although certain illustrative embodiments have been described in detail above, variations and modifications exist within the scope and spirit of this disclosure as described and as defined in the following claims.

The invention claimed is:

1. An apparatus for positioning a patient during spinal surgery comprising:

a main frame including two laterally spaced longitudinal rails, each longitudinal rail having a longitudinal length, and a positioner supported on the main frame, the positioner including a patient supporting frame supported on the main frame and rotatable about a first axis, the first axis being generally parallel to the longitudinal length of the main frame, the patient supporting frame having first and second sides, with the first side being adjacent the first axis and the second side being spaced apart from the first side, the patient supporting frame being pivotable about the first axis between a first position wherein the first and second sides of the patient supporting frame are generally equally spaced from the main frame and a second position wherein the second side is spaced farther from the main frame than the first side, a cushion supported on the patient supporting frame, the cushion supporting the patient in a prone position when the patient supporting frame is in the first position, a lateral support supported on the patient supporting frame, the lateral support engaging and supporting the patient when the patient supporting frame is rotated about the first axis to the second position, and a variable length actuator having a first end secured to the main frame at a first pivot that is fixed relative to the main frame and a second end secured to the patient supporting frame at a second pivot that is movable relative to the main frame such that the entire actuator is interposed between the main frame and the patient supporting frame, the variable length actuator operable to move the patient supporting frame between the first and second positions.

2. The apparatus of claim 1, wherein the patient supporting frame comprises two laterally spaced longitudinal rails, and wherein the cushion is secured to the longitudinal rails of the patient supporting frame.

3. The apparatus of claim 2, wherein the patient supporting frame of the positioner comprises a lateral cross-bar coupling the longitudinal rails of the patient supporting frame, and wherein the positioner further comprises a lateral arm secured to the longitudinal rails of the main frame, the patient supporting frame of the positioner being pivotably connected to the lateral arm.

4. The apparatus of claim 3, wherein the variable length actuator that moves the patient supporting frame about the first axis of the positioner is pneumatically operated.

5. The apparatus of claim 3, wherein the patient supporting frame is manually movable about the first axis.

6. The apparatus of claim 3, wherein the positioner further comprises a powered actuator operable to rotate the patient supporting frame about the first axis.

7. The apparatus of claim 3, wherein the powered actuator is pneumatically actuated.

8. The apparatus of claim 3, wherein the variable length actuator comprises a strut and the position of the patient supporting frame relative to the main frame is maintained by the strut that supports the patient supporting frame relative to the main frame.

9. The apparatus of claim 8, wherein the positioner further comprises a first pivot support coupled to the lateral arm and a second pivot support coupled to the lateral cross-bar, the strut being pivotably coupled to both the first pivot support and the second pivot support.

10. The apparatus of claim 3, wherein the positioner further comprises a first pivot support coupled to the lateral arm, a second pivot support coupled to the lateral cross-bar, and an actuator pivotably coupled to both the first pivot support and the second pivot support and operable to move the patient supporting frame between the first and second positions.

11. The apparatus of claim 3, wherein the main frame defines a longitudinal axis that is parallel to and centered between the longitudinal rails of the main frame and wherein the first axis is generally parallel to and spaced apart from the longitudinal axis of the main frame.

12. The apparatus of claim 3, wherein the patient supporting frame is movable relative to the lateral arm such that the lateral cross-bar of the patient supporting frame forms an acute angle with respect to the lateral arm.

13. The apparatus of claim 3, wherein the main frame further comprises a cross-bar coupled to the longitudinal rails of the main frame, and wherein the patient supporting frame is movable relative to the cross-bar of the main frame such that the lateral cross-bar of the patient supporting frame forms an acute angle with respect to the cross-bar of the main frame.

14. The apparatus of claim 1, wherein the patient supporting frame of the positioner comprises two laterally spaced longitudinal rails and a lateral cross-bar coupling the longitudinal rails of the patient supporting frame and wherein the main frame further comprises a cross-bar coupled to the longitudinal rails of the main frame, the patient supporting frame being movable relative to the cross-bar of the main frame such that the lateral cross-bar of the patient supporting frame forms an acute angle with respect to the cross-bar of the main frame.

15. The apparatus of claim 14, wherein the positioner further comprises a lateral arm secured to the main frame, the patient supporting frame of the positioner being pivotably connected to the lateral arm.

16. The apparatus of claim 15, wherein the main frame defines a longitudinal axis that is parallel to and centered between the longitudinal rails of the main frame and wherein the first axis is generally parallel to the longitudinal axis of the main frame and spaced apart from the longitudinal axis of the main frame.

* * * * *